US005880751A

United States Patent [19]

Nishikori et al.

[11] Patent Number: 5,880,751

[45] Date of Patent: Mar. 9, 1999

[54] INK JET RECORDING APPARATUS AND INK DROPLET AMOUNT EJECTION CONTROL METHOD THEREFOR

[75] Inventors: Hitoshi Nishikori, Kawasaki; Masato Katayama, Yokohama; Hiroshi Tajika, Yokohama; Noribumi Koitabashi, Yokohama, all of Japan

[73] Assignee: Canon Kabushiki Kaisha, Tokyo, Japan

[21] Appl. No.: 454,737

[22] Filed: May 31, 1995

[30] Foreign Application Priority Data

May 31, 1994 [JP] Japan ..... 6-119275

[51] Int. Cl.[6] ..... B41J 29/38

[52] U.S. Cl. ..... 347/14

[58] Field of Search ..... 347/14, 17, 12, 347/19, 20, 23, 40, 42, 49, 56, 67

[56] References Cited

U.S. PATENT DOCUMENTS

| | | | |
|---|---|---|---|
| 4,313,124 | 1/1982 | Hara | 29/726 |
| 4,345,262 | 8/1982 | Shirato et al. | 347/56 |
| 4,459,600 | 7/1984 | Sato et al. | 347/56 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,581,281 | 12/1996 | Fuse | 347/14 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |
| 5-92565 | 4/1993 | Japan . |

*Primary Examiner*—N. Le
*Assistant Examiner*—L. Anderson
*Attorney, Agent, or Firm*—Fitzpatrick, Cella, Harper & Scinto

[57] ABSTRACT

An ink ejection control method for an ink jet recording apparatus having a recording head, and an ink jet recording apparatus, include features of detecting operating conditions relating to a state of ink ejection from the recording head, detecting temperature adjacent to the recording head and changing a driving signal for driving the recording head for ejecting ink from the recording head, on the basis of the results of the state detection and the temperature detection.

23 Claims, 19 Drawing Sheets

| TABLE# | (1) | (2) | (3) | (4) | (5) | (6) | (7) | (8) | (9) | (10) | (11) |
|---|---|---|---|---|---|---|---|---|---|---|---|
| H. TEMP $T_H$ (°C) | "<"26 | "≧"26 ~ "<"29.3 | "≧"29.3 ~ "<"32.6 | "≧"32.6 ~ "<"35.9 | "≧"35.9 ~ "<"39.2 | "≧"39.2 ~ "<"42.5 | "≧"42.5 ~ "<"45.8 | "≧"45.8 ~ "<"49.1 | "≧"49.1 ~ "<"52.4 | "≧"52.4 ~ "<"55.7 | "≧"55.7 |
| PREHEAT PULSE WIDTH $P_1$ (Hex) | 0A | 09 | 08 | 07 | 06 | 05 | 04 | 03 | 02 | 01 | 00 |

1H=0.187 (μsec)

FIG. 2

| TABLE # | (1) | (2) | (3) | (4) | (5) | (6) | (7) | (8) | (9) | (10) | (11) |
|---|---|---|---|---|---|---|---|---|---|---|---|
| H. TEMP $T_H$ (°C) | "<"23.4 | "≧"23.4 ∫ "<"26.7 | "≧"26.7 ∫ "<"30 | "≧"30 ∫ "<"33.3 | "≧"33.3 ∫ "<"36.9 | "≧"36.9 ∫ "<"40.2 | "≧"40.2 ∫ "<"43.5 | "≧"43.5 ∫ "<"46.8 | "≧"46.8 ∫ "<"50.1 | "≧"50.1 ∫ "<"53.4 | "≧"53.4 |
| PREHEAT PW $P_1$ (Hex) | 0A | 09 | 08 | 07 | 06 | 05 | 04 | 03 | 02 | 01 | 00 |

1H = 0.187 (μsec)

FIG. 3

| TABLE # | (1) | (2) | (3) | (4) | (5) | (6) | (7) | (8) | (9) | (10) | (11) |
|---|---|---|---|---|---|---|---|---|---|---|---|
| H. TEMP $T_H$ (°C) | "<"26 | "≧"26 ~ "<"28 | 28 ~ 30 | 30 ~ 32 | 32 ~ 34 | 34 ~ 36 | 36 ~ 38 | 38 ~ 40 | 40 ~ 42 | 42 ~ 44 | "≧"44 |
| PREHEAT PW $P_1$ (Hex) | 0A | 09 | 08 | 07 | 06 | 05 | 04 | 03 | 02 | 01 | 00 |

1H=0.187 (μsec)

FIG. 14
PRIOR ART

INK JET RECORDING APPARATUS AND INK DROPLET AMOUNT EJECTION CONTROL METHOD THEREFOR

FIELD OF THE INVENTION AND RELATED ART

The present invention relates to an ink jet recording apparatus for outputting character, image or other information on a recording material for an information processing system such as a copying machine, a facsimile machine, a printer, a word processor, a personal computer or the like, and an ink droplet ejection quantity control method for an ink jet recording head used with the ink jet recording apparatus. The present invention also relates to an information processing system using the same.

As for a recording system used with a recording apparatus for ejection recording of a character, an image or the like on recording material (recording sheet) such as a paper, a textile, a plastic sheet, an OHP sheet or the like, various systems are known such as a wire dot system, a heat sensitive system, a thermal transfer system, an ink jet system or the like. Among these systems, the ink jet system is a type of non-impact system with low noise in which the ink is ejected to be directly deposited on the recording sheet. Depending on the formation method of the ink droplet and the ejection energy generating method, the ink jet system is classified into a continuous type (charged particle control system and spray system) and an on-demand type (piezoelectric system, spark system and bubble jet system).

In the continuous system, the ink is continuously ejected, and the electric charge is applied only to the necessary droplets so that only the charged droplets are deposited on the recording sheet. Therefore, the ink not deposited on the recording sheet is used wastefully. On the other hand, the on-demand system is such that the ink is ejected only upon necessity, and therefore, the ink is not wastefully used, and in addition, the inside of the apparatus is not contaminated. In the on-demand system, the ink ejection is started and stopped, and therefore, the response frequency is relatively low as compared with the continuous system. Therefore, in the on-demand system, the number of nozzles for ejecting the ink is increased, by which the recording speed is increased. Therefore, most of the commercially available recording machines are of the on-demand type. The recording apparatus using such an ink jet recording head is capable of effecting high density and high speed recording. Therefore, they are commercialized and used as output means for an information processing system such as a printer for a copying machine, a facsimile machine, an electronic typewriter, a word processor, a work station or the like, or a handy or portable type printer or a personal computer, host computer, optical disk, video apparatus or the like. In this case, the ink jet recording apparatus has a structure corresponding to the function or the use of each of the apparatuses.

Generally speaking, the ink jet recording apparatus comprises a carriage for carrying a recording means (recording head) and an ink container, a feeding means for feeding a recording sheet, and control means for controlling them. The recording head for ejecting the ink droplets through a plurality of ejection outlets is scanningly moved in a main scan direction which is perpendicular to a sub-scan direction (recording sheet feeding direction), while the recording sheet is intermittently fed when the recording operation is not carried out through a distance corresponding to a recording width. This method is advantageous in that the running cost is low, and the noise level is low, and therefore, is widely used. By using a recording head having a large number of ink ejecting nozzles arranged on a line in the sub-scan direction, recording is possible with the recording width corresponding to the number of nozzles, by one scan of the recording head on the recording sheet. Therefore, the recording operation speed can be increased.

Additionally, in the case of a color ink jet recording apparatus, color images can be formed by overlaying ink droplets ejected from plural color recording heads. Generally, in the case of color recording, the use is made with a recording head or recording heads for three primary colors, yellow (Y), magenta (M) and cyan (C), or a recording head or recording heads for these colors plus black (B) and ink cartridges therefor. Recently, an apparatus capable of forming a full color image using 3–4 color recording heads was put into practice.

Additionally, the ink jet recording apparatus can be relatively easily manufactured, which can effect a large size recording such as A1 or the like. That is, the ink jet recording apparatus can be used with an image reader and can record on A1 size sheet, and can be a CAD output printer (plotter). Additionally, the ways of use of the printer become wider to such an extent that the record is effected on an OHP film for an overhead projector. To meet such a demand, the recording apparatus is capable of effecting optimum recording irrespective of the recording material even when various recording materials having different ink absorbing properties are used.

Such an ink jet recording apparatus is also usable in textile printing, and further high quality printing is desired.

However, a conventional ink jet recording head involved a problem that the amount or quantity of the ink ejection changes with a change of the temperature (ink temperature change). As a method for solving the problem, the driving pulse width for the recording head is changed in an attempt to control the ejection quantity. An additional problem is that due to the temperature change of the recording head due to the self temperature increase or due to the ambient condition change, the ejection speed and the ink refilling frequency or the like changes with the result of improper ink droplet ejection. Japanese Laid-Open Patent Application No. 92565/1993 discloses as a proposal for solving the problem a method of controlling ejection amount using divided pulses.

FIG. 9 illustrates the divided pulses used therein.

FIG. 9 shows a pulse applied for one driving period, and shows a change of the voltage relative to time t.

In FIG. 9, Vop is a driving pulse, P1 is a pulse width of the initial pulse (preheat pulse) in the multiple heat pulses divided, P2 is an interval time, and P3 is a pulse width of the second pulse (main heat pulse). In this Figure, T1, T2 and T3 indicate times for determining the pulses P1, P2 and P3. The driving voltage Vop provides electric energy required for producing thermal energy in the ink in the liquid passage constituted by the top plate and the heater board, using the electrothermal transducer (heat generating element). The voltage is determined on the basis of the area, resistance and a film structure of the electrothermal transducer element and the structure of the liquid passage of the recording head. In the divided pulse modulation driving method, the pulse and the interval time are provided with the widths P1, P2 and P3, sequentially. The pre-heat pulse is effective to control the temperature of the ink in the ink passage, and is an important factor in the ejection amount control in this invention. The pulse width P1 of the pre-heat pulse is so determined that no bubble is formed in the liquid by the thermal energy produced by the electrothermal transducer supplied with the pulse width P1.

The interval time is provided in order to give a predetermined interval to prevent interference between the pre-heat pulse and the main heat pulse and in order to make uniform the ink temperature distribution in the ink passage by dissipating the thermal energy provided by the pre-heat pulse. By the pre-heat pulse and the interval time, the temperature of the ink in the ink passage can be controlled to a proper level. The main heat pulse functions to generate a bubble in the ink in the ink passage and to eject the ink through the ejection outlet. The pulse width P3 is determined on the basis of the area, resistance and the film structure of the electrothermal transducer element and the structure of the ink passage of the recording head.

The description will be made as to the preheat pulse in the recording head having the structure shown in FIG. 10A and FIG. 10B, for example.

In FIGS. 10A and 10B, an exemplary structure of a conventional recording head is shown, with sectional and front views along the ink passage.

In FIGS. 10A and 10B, a reference numeral 1 indicates an electrothermal transducer for producing heat by application of divided pulses. The electrothermal transducer 1 is disposed on a heater board 9 together with electrode wiring or the like for applying the divided pulses thereto. The heater board 9 is made of silicon, and is supported on an aluminum plate functioning as a base plate of the recording head. Reference numeral 12 indicates a top plate having grooves constituting ink passages or the like. By coupling the top board 12 and the heater board 9 (aluminum plate 11), the ink passages 3 and the common liquid chamber 5 for supplying the ink thereto are constituted. The top plate 12 has ejection outlets 7, and ink passages 3 are formed in fluid communication with the respective ejection outlets 7.

In the recording head shown in FIGS. 10A and 10B, when the pre-heat pulse width P1 is changed in the range between 0–3.000 ($\mu$sec) with the driving voltage Vop of 18.0 volt, and main heat pulse width P3 of 4.114 ($\mu$sec), the relationship between the ejection amount Vd (ng/dot) and the pre-heat pulse width P1 ($\mu$sec) is shown in FIG. 11.

FIG. 11 is a diagram showing the dependency of the ejection amount on the pre-heat pulse, and the pre-heat pulse dependency of the ejection property will be described in the case of the ejection amount. In the Figure, V0 shows the ejection amount when P1 is 0 ($\mu$sec). The value is determined on the basis of the structure of the recording head shown in FIG. 10. Therefore, the value V0 in this example is 18.0 (ng/dot) at the ambient temperature TR of 25° C. As shown in the curve a the ejection amount Vd increases linearly from the pulse width P1=0 to P1LMT in accordance with an increase of the pulse width P1 of the pre-heat pulse, and in the range in which the pulse width P1 is larger than P1LMT, the change loses the linearity, and it saturates at the pulse width P1=P1MAX (maximum).

As described, the range up to the pulse width P1LMT in which the change of the ejection amount Vd relative to the change of the pulse width P1 shows the linearity, is effective to easily control the ejection amount by the change of the pulse width. Therefore, in this example (curve a), P1LMT= 1.87 $\mu$sec, and the ejection amount at this time is VLMT= 24.0 (ng/dot). The pulse width P1MAX when the ejection amount Vd is saturated is P1MAX=2.1 ($\mu$sec), and the ejection amount at this time VMAX is 25.5 (ng/dot).

When the pulse width is larger than P1MAX, the ejection amount Vd is smaller than VMAX. This phenomenon is explained as follows. When the pre-heat pulse having the pulse width in this range is applied, the state immediately before the film boiling occurs with the result of fine bubbles formed on the electrothermal transducer element, and the next main heat pulses applied before the bubbles disappear. The disturbance of the fine bubbles to the bubble formation by the main heat pulse, thus reduces the ejection amount. This range is called the pre-bubble-formation range, in which the ejection amount control is difficult using the pre-heat pulse. In addition, since the interval time P2 is short, the heat applied by the pre-heat pulse P1 is not sufficiently distributed within the ink, and therefore, a sufficient ejection amount is not provided. If the inclination of the line in the relationship between the ejection amount and the pulse width in the range of the pulse width P1 from 0–P1LMT ($\mu$sec) in FIG. 11 is defined as a pre-heat pulse dependency coefficient, it is $$KP = \frac{\delta VdP}{\delta P1} \quad (ng/\mu\text{sec} \cdot \text{dot}).$$

The coefficient KP is not influenced by the temperature, but is determined by the recording head structure, the driving condition, the ink property or the like. Curves b and c in FIG. 11, therefore, indicate other recording heads. As will be understood, the ejection property changes if the recording head is different.

In this manner, if the recording head is different, the upper limit P1LMT of the pre-heat pulse P1 is different, and therefore, the upper limit P1LMT is determined for an individual recording head as will be described hereinafter, so as to effect the ejection amount control.

Therefore, in the recording head and the ink indicated by the curve a in this example, Kp=3.209 (ng/$\mu$sec.dot).

As another factor influential to the ejection amount in the ink jet recording head, there is a recording head temperature. In addition, the ink temperature in the recording head changes in accordance with the temperature of the recording head and the temperature adjacent thereto, and the change of the ejection amount can be designated on the basis of the ink temperature.

FIG. 12 shows a temperature dependency of the ejection amount. As shown in curve a in FIG. 12, the ejection amount Vd linearly increases relative to the increase of the ambient temperature TR (head temperature TH) of the recording head.

The inclination of the line is defined as the temperature dependency coefficient, which is $$KT = \frac{\delta VdT}{\delta TH} \quad (ng/\mu\text{sec} \cdot \text{dot}).$$

The coefficient KT is not influenced by the driving condition, but is determined by the structure of the recording head and the property of the ink. In FIG. 11, curves b and c indicate other recording heads. Therefore, in the recording head of this example, KT was 0.3 (ng/° C.dot).

The description will be made as to the ejection amount control using the pulse width modulation of the divided pulse.

FIG. 13 illustrates pulse width modulation for suppressing the variation of the ejection amount (Vd) relative to the head temperature (TH) change. In this Figure, the pulse width modulation range is a range (26°–44° C., for example) having a relatively high temperature not less than T0 of the recording head provided by the self temperature rise as a result of ink ejecting operations and/or increase of the ambient temperature. The temperature is detected by the temperature sensor, and the pre-heat pulse width P1 is changed in accordance with a table shown in FIG. 14. FIG. 15 shows pulse widths corresponding to the respective tables in FIG. 14. The sequential operation of the pulse width modulation at this time is shown in FIG. 16. In the case of the recording head of this example, the upper limit P1LMT of the pulse width P1 is OA (Hex) shown by Table No. 1 in FIG. 14, that is, (1) in FIG. 14. This upper limit is determined by table pointer information, as will be described hereinafter.

Referring to FIG. 16, the ejection amount control using the pulse width modulation shown in FIG. 14 will be described.

The sequence shown in FIG. 16 is started by interruption at every 20 msec, for example, and at first, the recording head temperature is detected at step S81. Subsequently, at step S82, in order to prevent erroneous detection of the temperature due to electrical noise or heat flux entering the temperature sensor, an average Tn of the temperature detecting at step S81 and the past three head temperatures is calculated as the head temperature T1'. At step S83, a comparison is made among the average T1'=Tn, the previous head temperature T1'=Tn−1, and the upper limit temperature TTBL corresponding to the pulse width at the time of Table 2 in FIG. 14. Here, if the difference TTBL−Tn is a width in a temperature range in which the ejection amount is constant when the pulse width is changed by one unit pulse width (0.187 sec) corresponding to the pulse widths corresponding to the table numbers in FIG. 14, that is, a predetermined temperature step width δT (δT corresponding to the temperature range of 2° C. in FIG. 14), the pulse width Pr is not changed at step S58. If the difference is larger than δT, the operation proceeds to step 86.

Furthermore, by increasing the table number to be referred to in FIG. 14, the pulse width P1 is lowered by one unit to reduce the ejection amount. When the difference is smaller than −δT, the operation proceeds to step S84. By reducing the table number by one, the pulse width P1 is increased by one step to increase the ejection amount so as to maintain a constant ejection amount Vd0. In the above-described process, the reason why the width of the pulse width P1 changes in the unit pulse width is to prevent density jump by preventing erroneous operation (erroneous detection for the temperature by the temperature sensor) for the feedback operation.

By carrying out the above-described control, the ejection amount control is possible within a ±δV range in the temperature range in which the table in FIG. 14 is applicable, relative to the target ejection amount Vd0. The change of the ejection amount is as indicated by a curve a as in FIG. 11.

However, with the ejection amount control using the above-described pulse width change, when high duty printing is carried out continuously, the ejection amount decreases due to the steep temperature rise as a result of the printing operation, while the printing duty is low, the ejection amount can be maintained constant. In other words, with the ejection amount control with the conventional pulse width control, the head temperature is detected by a temperature sensor in the recording head, and on the basis of the temperature detected, the pulse width is controlled to maintain a constant ejection amount. On the other hand, the ejection amount is dependent on the temperature of the ink itself. Therefore, if the temperature of the recording head steeply increases as a result of a printing operation, a remarkable difference occurs between the recording head temperature and the ink temperature in the recording head. More particularly, the ink temperature is lower than the head temperature.

For example, FIG. 17 shows the head temperature and the ink temperature ranges when 100% duty printing is carried out for a plurality of lines. As a result, the pulse width control is carried out on the basis of the detected head temperature which is higher than the actual head temperature, and therefore, the ejection amount decreases.

In the following, the description will be made as to the case in which the ink temperature is lower than the head temperature upon the temperature increasing.

Since the printing operation is carried out for a plurality of lines, the ejection state and the non-ejection state appear alternately, and therefore, the temperature increasing portions and temperature decreasing portions appear alternately. A temperature at which the ink jet recording apparatus changes from the non-ejection to the ejection state ("o" in FIG. 17), is called a "base point", and the temperature at the base point is called the "base temperature".

As will be understood from FIG. 17, the head temperature and the ink temperature are substantially equal at the base point. This is because when the comparison is made between the heat exchange between the head and the ink and the heat exchange between the head and the outside of the head, the former is significant, and because when the comparison is made between the thermal capacity of the ink and the thermal capacity of the head, the former is much larger, and because there exists a sufficient time period from the end of printing for one line and the start of the printing of the next line.

Therefore, upon the start of the ejection, the head temperature (output of the temperature sensor) and the ink temperature can be deemed substantially equal.

FIG. 18 depicts plots of the head and ink temperature rises against the printing duty during the printing operation, as a result of a continuous one line printing operation. The temperature rising curves for the head and the ink in FIG. 18 are substantially similar. Additionally, the temperature rise curves of the head and the ink during one line printing are substantially similar (FIG. 17).

Referring to FIG. 18, (head temperature rise)/(ink temperature rise) is ⅔, approximately, irrespective of the printing duty.

FIG. 19 shows a reduction of reflection optical density (OD) when the continuous printing operation is carried out with a 100% duty. In this Figure, the ordinate represents the value of OD, and the abscissa represent the time after the start of the printing operation. The broken line represents the OD when the assumption is made that the ejection amount is constant during the printing operation (P), and the solid line represents the OD value actually detected. As will be clear from this Figure, OD decreases with an elapse of time. This means that the ejection amount reduces with an elapse of time when the printing operation is continuously carried out with a high printing duty.

FIG. 12 shows the dependency of the ejection amount on the ink temperature. In this Figure, the ordinate represents the ink ejection amount (p1) at one time, and the abscissa represents the ink temperature (° C.) in the recording head. The measurement of the ejection amount is carried out during the repetition of the 100% duty printing for a short time period and a resting period (non-printing) with the fixed pulse width, in order to prevent the influence of the self temperature rise of the recording head and/or in order to prevent occurrence of the difference between the head temperature and the ink temperature. As will be clear from this Figure, when the ink temperature increases from 25° C. to 27° C., the ejection amount increases from Vd0 to Vd1.

FIG. 21 shows a relationship between an ejection amount and a reflection optical density of the print when the printing operation is carried out with 100% duty. In this Figure, the ordinate represents a reflection optical density (OD), and the abscissa represents the ejection amount (p1). The reflection optical density OD0 is obtained when the ink temperature is 25° C., and the ejection amount is Vd0. When the ink temperature increases from 25° C. to 27° C., the reflection optical density observed increases from OD0 to OD1. Such an increase harmonizes with an increase of the ejection amount from Vd0 to Vd1.

FIG. 22 shows a reflection optical density change due to the self temperature rise of the recording head when the printing operation is carried out for one line with 100% duty while the pulse width is fixed. In this Figure, the ordinate represents the reflection optical density (OD), and the abscissa represents the printing time (sec). Upon the printing operation starting, the temperature of the recording head was 25° C., and becomes 30° C. t1 sec after the start of the printing. As will be clear from this Figure, when the recording head temperature increases from 25° C. to 30° C., the observed reflection optical density OD increases from OD0 to OD1.

By comparing the ink temperature dependencies of the reflection optical density in the one line printing of FIG. 22 and the reflection optical density calculated on the basis of FIGS. 20 and 21, the reflection optical density when the head temperature is 30° C. after a continuous printing operation is understood as corresponding to the calculated value at the ink temperature of 27° C.

Thus, when the self temperature rise of the recording head occurs by ejection of the ink droplets, the ejection amount decreases due to the difference between the ink temperature and the head temperature.

SUMMARY OF THE INVENTION

Accordingly, it is a principal object of the present invention to provide an ink jet recording apparatus and a method in which a stabilized ink ejection amount is maintained with a high quality of printing even if the recording head temperature is different from the ink temperature.

It is another object of the present invention to provide a control method for ink jet recording in which the stabilized ejection amount is maintained with a high quality of printing even if the recording head temperature and the ink temperature are different.

According to an aspect of the present invention, there is provided an ink ejection control method for an ink jet recording apparatus having a recording head, comprising: detecting a state of ink ejection; detecting a temperature adjacent the recording head; changing a driving condition for the recording head on the basis of results of said state detecting step and said temperature detecting step.

According to the present invention, a control table or an equation on the basis of the control table for modulating the driving signal to be supplied to the recording head is switched depending on whether the ejection is effected or not, and the control of the recording head is carried out on the basis of the switched table or an equation. Therefore, even if the ink temperature and the head temperature (output of the temperature sensor) are different, the driving signal supplied to the recording head is modulated in accordance with the ink temperature so as to maintain the ejection force at a proper level with high accuracy.

The high quality and high resolution recording operation is possible by using a system for ejecting the liquid using thermal energy (film boiling) as energy generating means for generating energy for ejecting the ink.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 2 shows an example of an ink droplet ejection amount control method according to this invention, and shows a control table 2.

FIG. 3 shows a control table 2 for the start of the printing with the temperature of 30° C.

FIG. 10 shows an example of a recording head used in a conventional ink jet recording apparatus, in which

FIG. 14 shows a control table 1 used in an example of a conventional ink droplet ejection amount control method.

DESCRIPTION OF THE PREFERRED EMBODIMENTS

Figure 1:
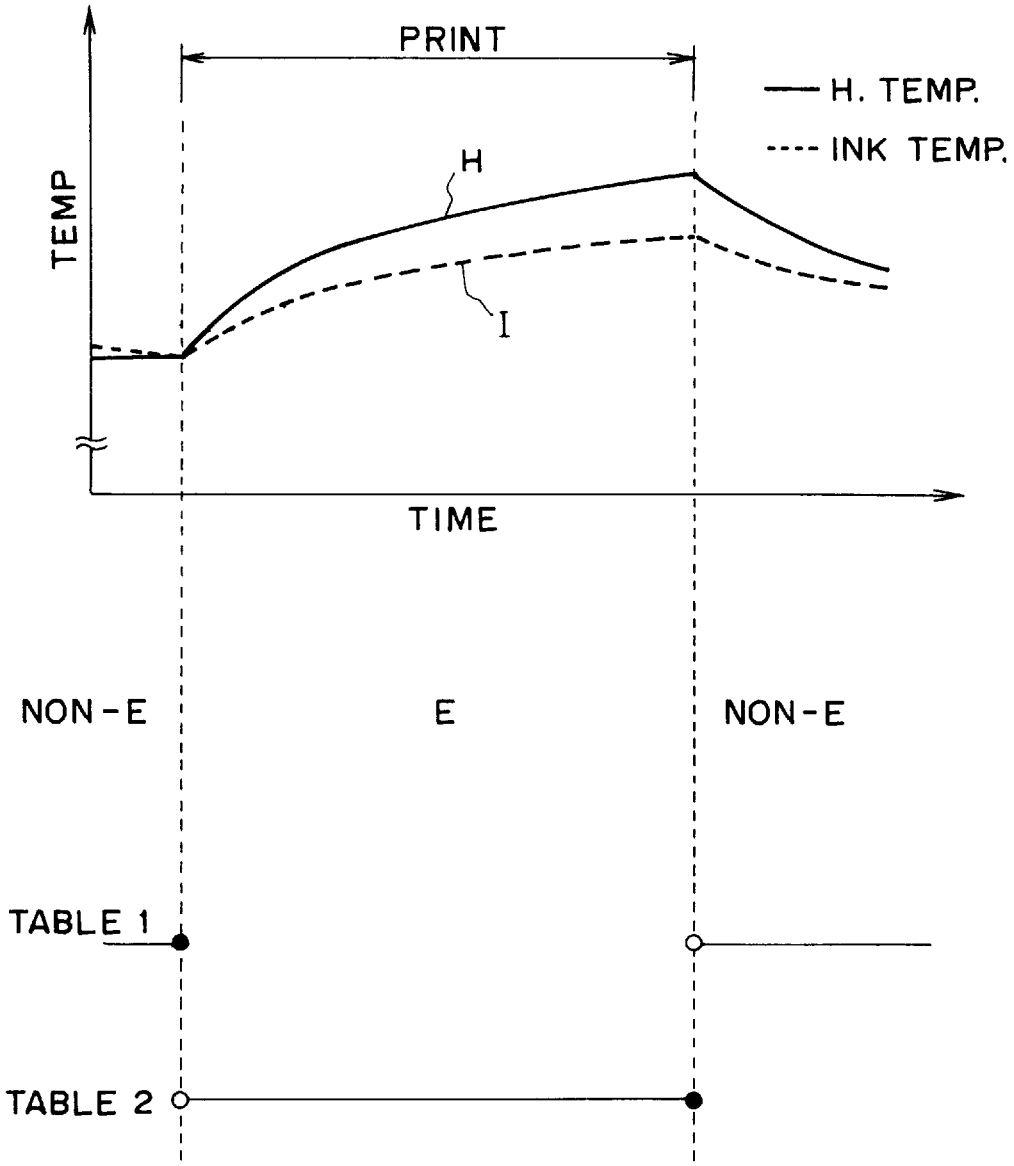
FIG. 1 illustrates an ink droplet amount control method according to an embodiment of the present invention, and shows switching timing between a control table 1 and a control table 2.

Referring to the accompanying drawings, the embodiments of the present invention will be described in detail.

This embodiment is based on the fact that the relationship between the head temperature rise and the ink temperature rise (head temperature rise)/(ink temperature rise) is ⅝ irrespective of the printing duty or the time period after the ejection state is established, as will be clear from the description of the conventional example, when there is a difference between the ink temperature and the head temperature when the recording apparatus is in the ejection state of the recording apparatus.

The ink jet recording head in the ink jet recording apparatus of this embodiment (is of a so-called bubble jet type) in which, for the energy generating means for generating the energy for ejecting the ink, film boiling is used. With this system, the ink droplet ejection outlets can be arranged at high density, and therefore, high resolution recording is possible.

Here, the ink droplet formation in the bubble jet system will be briefly described. When the temperature of the heat generating resistor (heater) reaches a predetermined level, film boiling occurs covering the heater surface. The internal pressure of the bubble is so high as to push out the ink in the nozzle. By the inertia of the pushing, the ink moves outwardly and inwardly (toward the common liquid chamber). With the movement of the ink, the internal pressure of the bubble becomes negative, and the speed of the ink reduces thereby, and in addition by the resistance in the passage. The ink ejected out through the nozzle (ejection outlet or orifice) has a higher speed than that of the ink in the nozzle, and therefore, the ink is narrowed as a total effect of the inertia, passage resistance, contraction of the bubble and the ink surface tension with the result of separation from the ink in the nozzle, so that a droplet is formed. Simultaneously with the contraction of the bubble, the ink is supplied from the common chamber into the nozzle by the capillary force, and when the next pulse is applied, the ejectable state is established.

By the recording head using the electrothermal transducer as the energy generating means, the bubble can be produced in the ink in the passage in one by one relationship with the driving electric pulse. In addition, since the development and contraction of the bubble occurs instantaneously, the ink droplet ejection can be accomplished with high responsivity. Additionally, the recording head can be easily downsized, and for the manufacturing thereof, the recent semiconductor manufacturing technique and a micro machining technique can be used with their advantages, and therefore, high density and low manufacturing cost can be accomplished.

Embodiment 1

In this embodiment, the waveform of the driving signal is changed to control the ejection amount. Preferably, the driving signal applied to the heat generating element for one ink ejecting operation comprises a plurality of signals. The waveform of the signal is modulated before the driving signal is modulated to control the ink ejection amount. Even if the ink temperature is the head temperature are different, the ink ejection amount can be stabilized by preparing a plurality of control conditions and by changing the control conditions for the recording head in accordance with the state of the main assembly and the recording operations. In this embodiment, the driving signal is pulsewise, and the pulse is divided into two parts, thus providing the above plural driving signals.

In the ink ejection amount control method of this embodiment, the use is made with the driving signal comprising the divided pulses. An optimum table is selected from a plurality of the control tables prepared depending on the state of the recording head and the printing condition, and the modulation of the driving signal is carried out on the basis of the table. First, the preparation is made for a table for the case in which the ink temperature and the head temperature are substantially equal (first table), and for a table (second table) for the case in which there is a temperature difference between the ink temperature and the head temperature due to the self temperature rise as a result of ejecting operations of the recording head.

Subsequently, the detection is made as to whether the recording head is in the ejecting state or in the non-ejecting state, and the table used is switched, and the pulse width control is carried out.

FIG. 1 shows the timing of the switching between the first table and the second table. In the non-ejecting state, the pulse width control is carried out in order to determine the pulse width upon the start of the ejection. In this embodiment, upon the ejection start, the table shown in FIG. 14 for the conventional pulse width control is used as the first table. This is because, upon the start of the ejection, the ink temperature and the head temperature are substantially equal. When the change to the ejecting state of the main assembly is detected, the table used for the pulse width control is switched to the second table. The second table is used for the pulse width control in accordance with the temperature of the ink on the basis of the head temperature detected by the temperature sensor on the basis of the fact that (head temperature rise)/(ink temperature rise) is generally equal to ⅝. It is determined in the following manner.

When the printing is started at 25° C., for example, the pulse width upon the ejection start is determined on the basis of the first table, and therefore, the pulse width from the table in FIG. 14 is OA (Hex) (wherein 1 Hex corresponds to 0.187 μsec). With the first table of FIG. 14, the pulse width is OA Hex in the range of the head temperature below 26° C., and therefore, in the second table, the pulse width below 26° C. is OA Hex. When the head temperature is higher than 26° C., the pulse width is reduced by 1 Hex for a 3° C. head temperature rise in consideration of the fact that (head temperature rise)/(ink temperature rise) is generally equal to ⅔, although with the first table, the pulse width is changed for every 2° C. head temperature rise. The table for this is shown in FIG. 2.

In the second table, for the printing start at 30° C., 08 Hex is used in the range of the head temperature below 30° C. on the basis of the first table in FIG. 14, and the pulse width is shortened by 1 Hex for every 3.3° C. temperature rise in the range above 30° C.

FIG. 3 shows a second table used when the printing operation starts at 30° C.

Figure 4:
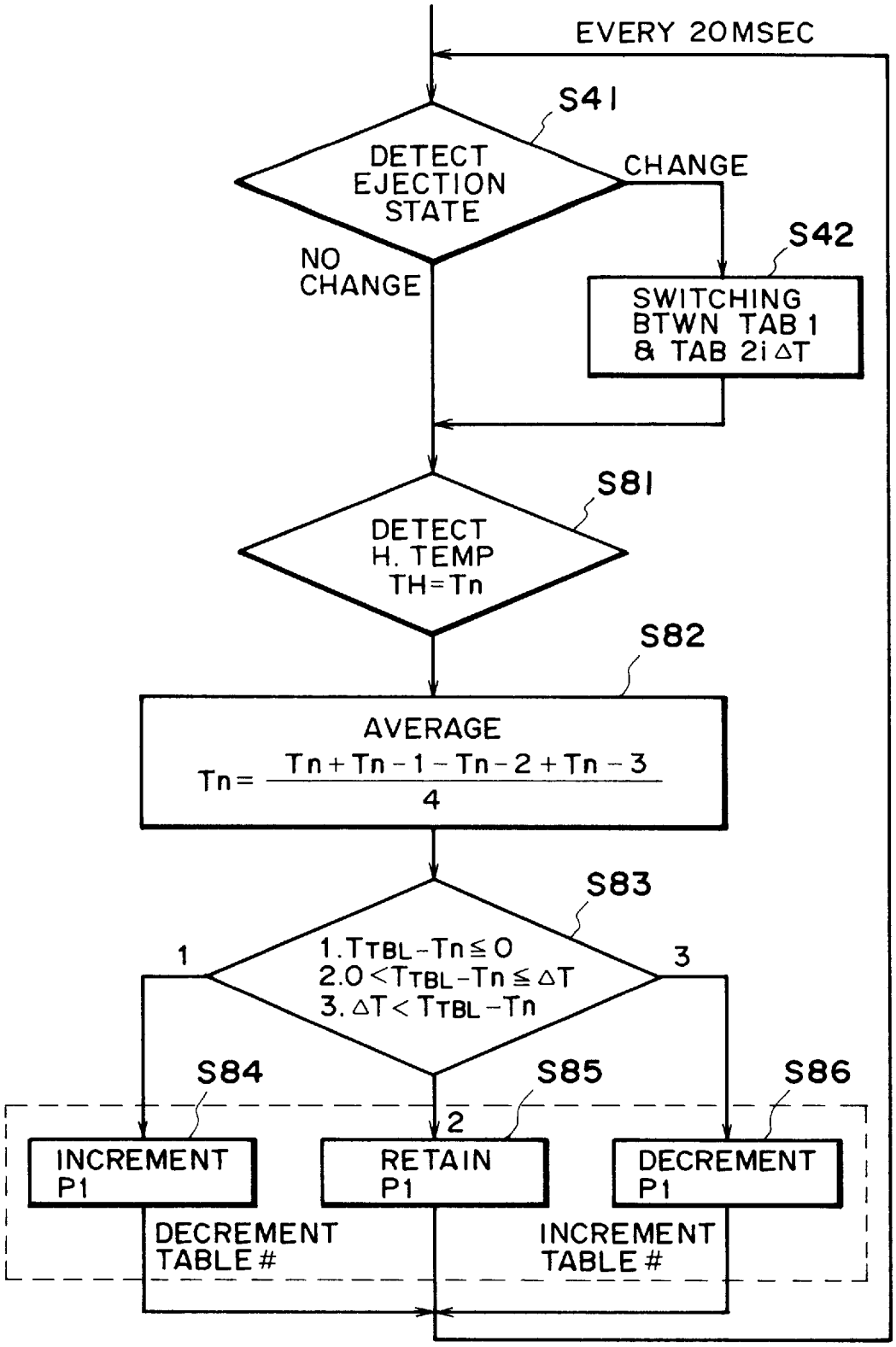
FIG. 4 shows a flow chart illustrating a sequential operation for the switching between the control table 1 and the control table 2.

The sequential operation for switching the table is shown in FIG. 4.

The interruption is made for every 20 msec to detect the change of the ejection state of the recording head (S41). If there is any change detected, the first table and the second table are switched (S42). Thereafter, the head temperature is detected, and the pulse width control is carried out in accordance with the table selected at this time.

Figure 19:
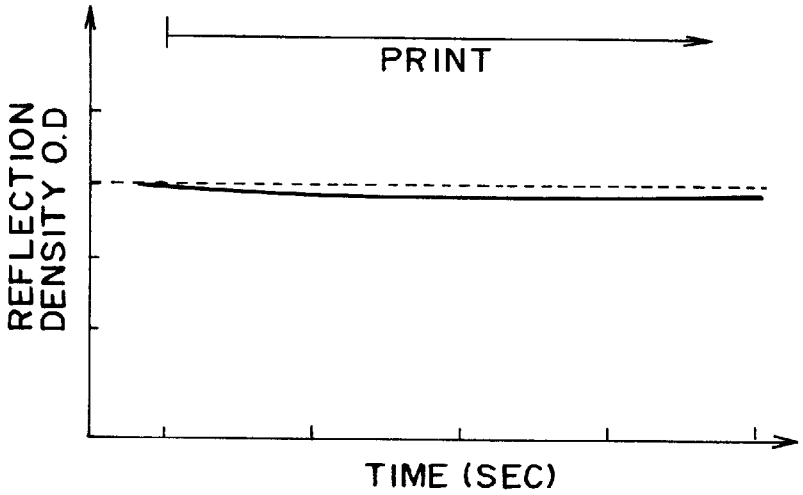
FIG. 19 PRIOR ART
FIG. 19 shows a reduction of reflection optical density when 100% duty continuous printing is carried out in an ink jet recording apparatus using a conventional ink droplet ejection amount control.
Figure 20:
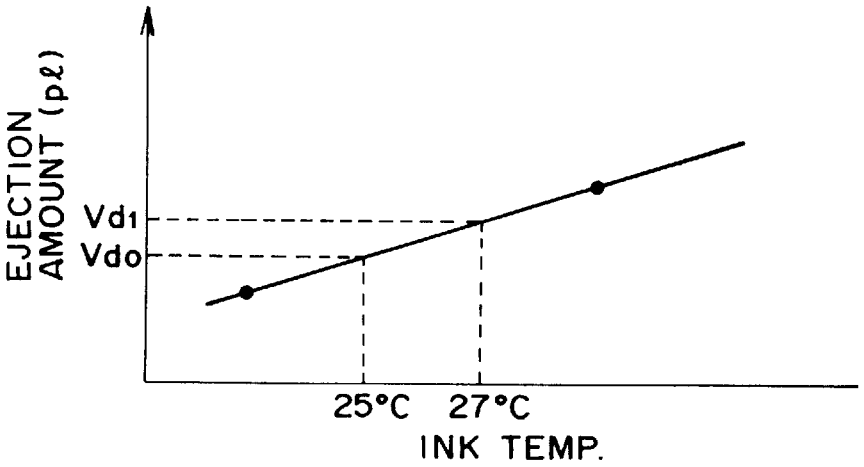
FIG. 20 shows an ink temperature dependency of the ink droplet ejection amount in an ink jet recording apparatus.
Figure 21:
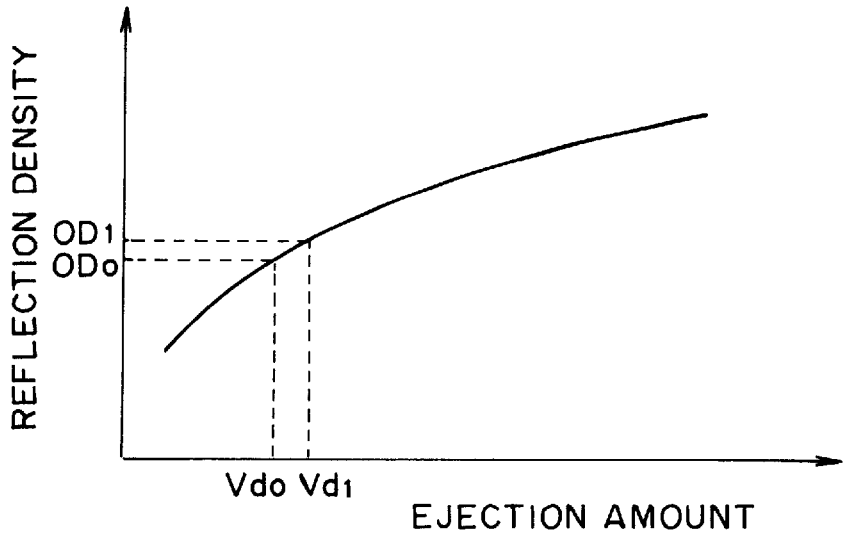
FIG. 21 shows a relationship between an ejection amount and a reflection optical density of print when a 100% duty printing operation is carried out in an ink jet recording apparatus.

By the pulse width control in this manner, the decrease of the reflection optical density when the conventional pulse width control described with FIG. 19 is carried out, can be avoided.

Figure 5:
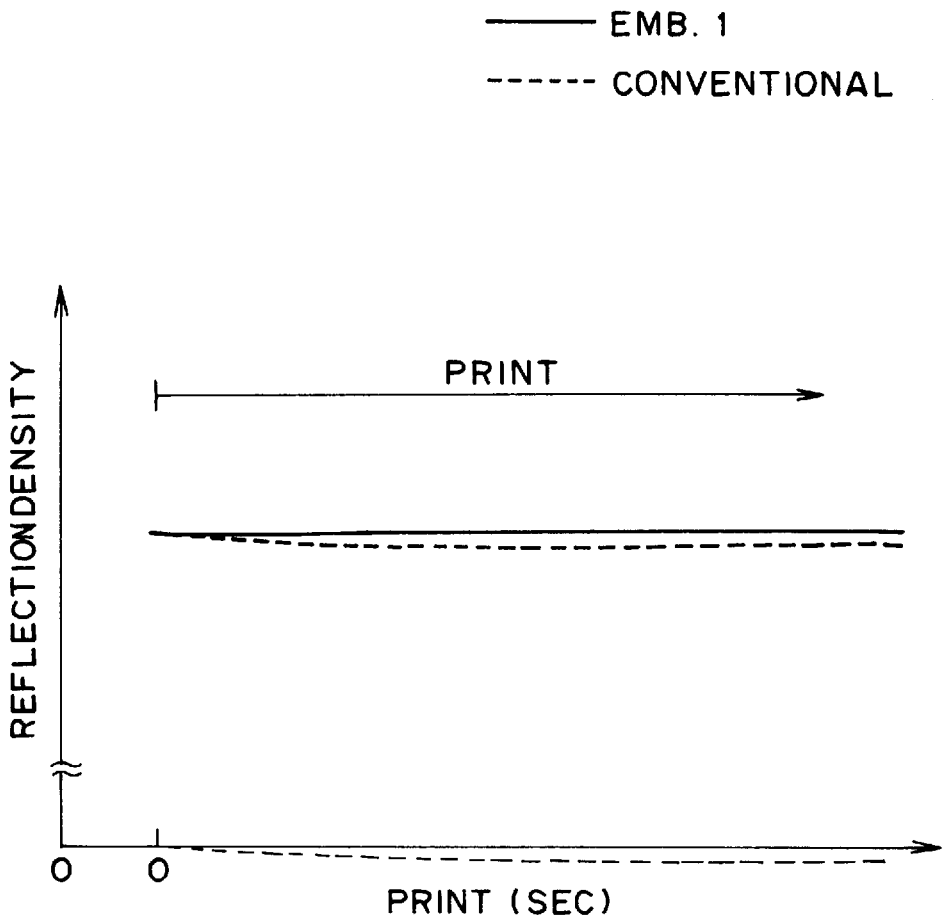
FIG. 5 shows a comparison between a conventional driving pulse width control and the driving pulse control in an ink jet recording apparatus using the ink droplet ejection amount control according to the present invention.
Figure 6:
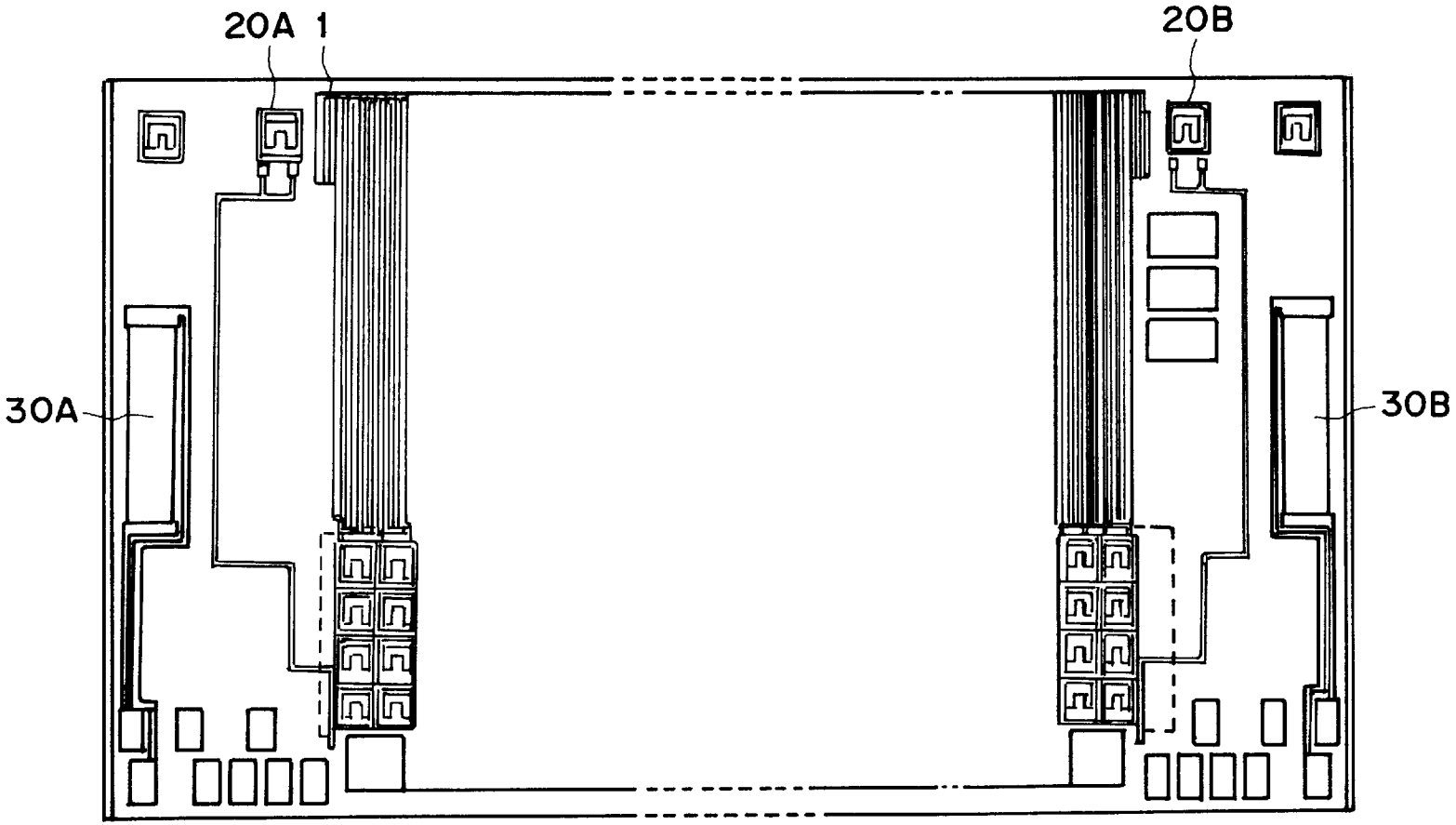
FIG. 6 is a front view illustrating a heater board of a recording head used with the ink droplet ejection amount control method according to the present invention.

FIG. 5 shows a comparison between this embodiment and the conventional example. FIG. 6 shows a heater board of a recording head to which the ink droplet ejection amount control method of this embodiment is used. On the heater board, there are a temperature sensor, a temperature control heater, ejection heaters or the like.

FIG. 6 is a top plan view of the heater board. In this Figure, the temperature sensors 20A and 20B are disposed adjacent the left and right ends of the array of the ejection heaters 1 on the silicon substrate 9. The ejection heaters 1, and the temperature sensors 20A and 20B are formed all at once through a semiconductor manufacturing process. In this embodiment, an average of the output of the temperature sensor 20A and the temperature sensor 20B is used as the temperature detected by the temperature sensor.

Figure 7:
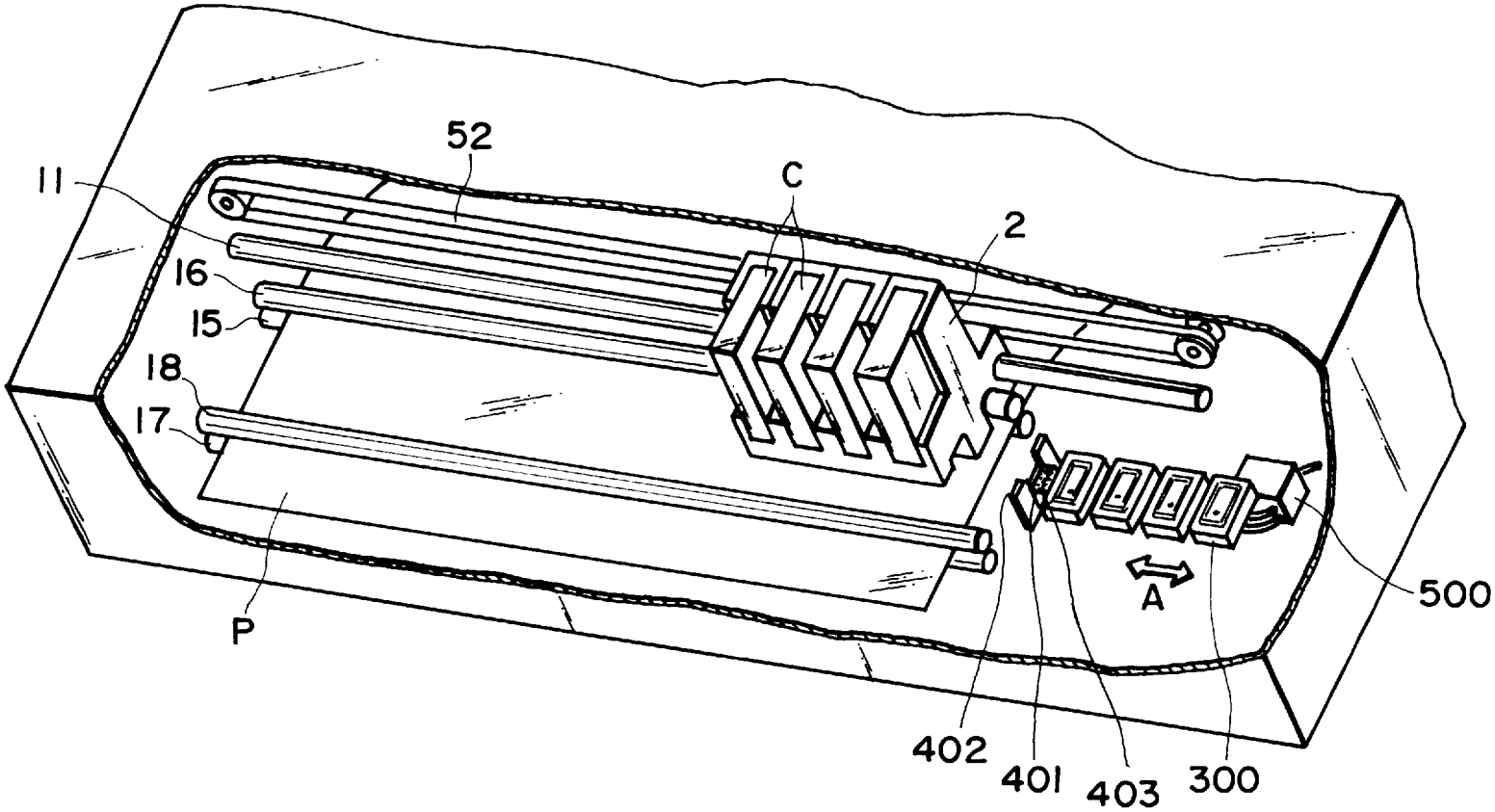
FIG. 7 illustrates the ink jet recording apparatus usable with the ink droplet amount control method.

FIG. 7 shows an ink jet recording apparatus using the ejection amount control method of this embodiment. The apparatus is in the form of a full-color serial type printer having black (BK), cyan (C), magenta (M) and yellow (Y) recording heads which are replaceable.

The recording head has specifications of 400 dpi in resolution, 4 kHz in the driving frequency, and is provided with 128 ejection outlets. In this Figure, four recording head cartridges C for Y, M, C and BK inks are provided, and the recording head cartridges comprise recording heads and ink containers for containing the inks to be supplied to the recording head, integrally. The recording head cartridge C is detachably mounted on a carriage. The carriage 2 is slidable along a guide shaft 11, and is connected with a driving belt 52 movable by a main scan motor (not shown). By doing so, the recording head cartridge C is movable along the guiding shaft 11 for the scanning operation. Feeding rollers 15, 16, 17 and 18 extend substantially with the guiding shaft 11 at the rear and front sides in the recording region by the scanning of the recording head cartridge C. Feeding rollers 15, 16, 17 and 18 function to feed the recording material with the aid of the operation of the sub-scan motor (not shown). The recording material P is brought faced to the ejection outlet side of the recording head cartridge C.

A recovery unit is provided faced to a region in which a cartridge C is movable, adjacent to the recording region of the recording head cartridge C. In the recovery unit, designated by a reference numeral 300 is a cap unit provided corresponding to each of the cartridges C having a recording head, and is slidable toward the left and right in the figure with movement of the carriage 2, and is also movable substantially vertically. When the carriage 2 is at the home position, it is coupled with the recording head to cap the recording head. In the recovery unit, designated by reference numerals 401 and 402 are first and second blades as wiping members, and 403 is a blade cleaner in the form of a liquid absorbing material, for example, to clean the first blade 401.

Designated by a reference numeral 500 is a pump unit for suctioning the ink from the ink ejection outlets or from the neighborhood thereof through the cap unit 300.

Figure 8:
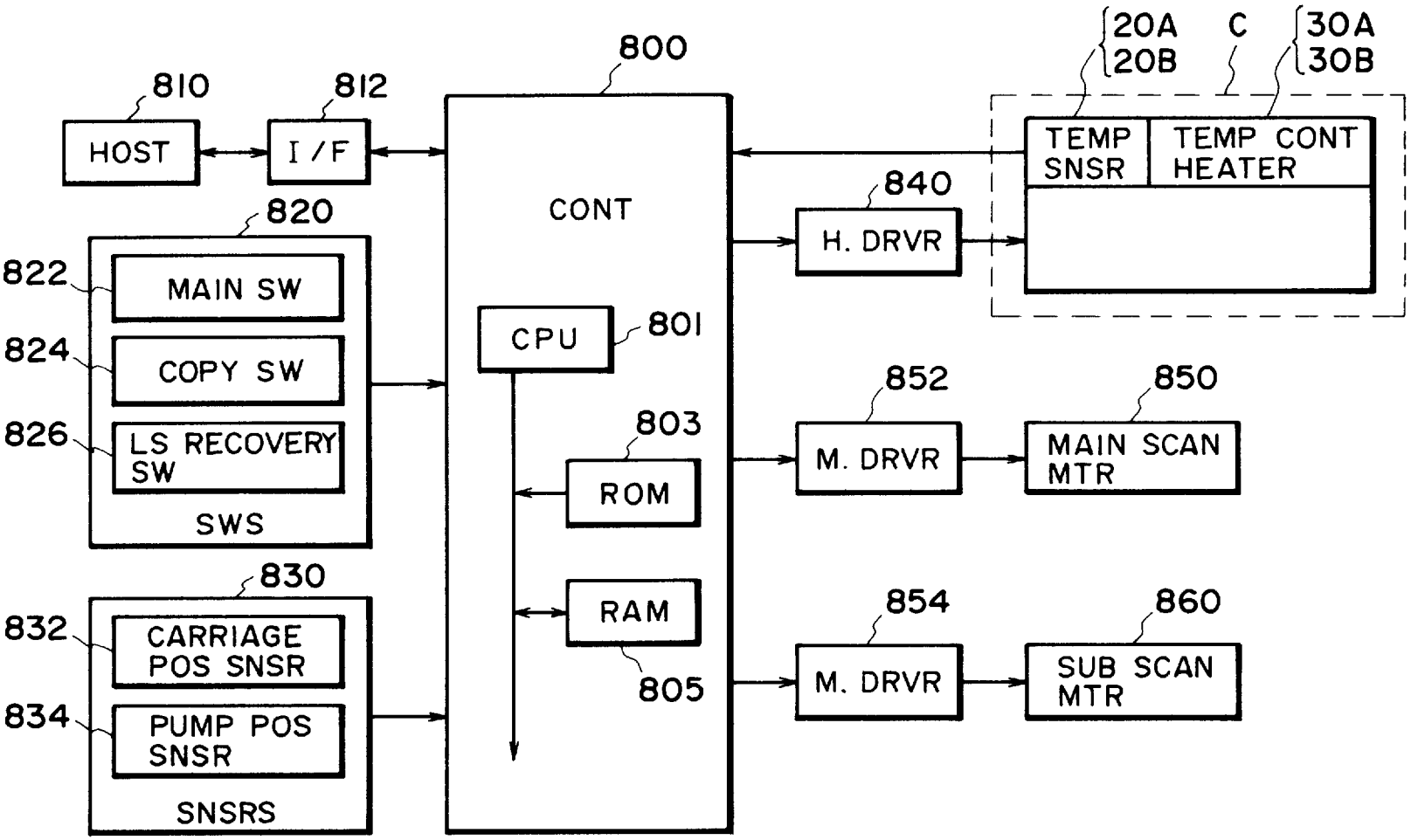
FIG. 8 is a block diagram of an example of the structure of a control system usable with an ink jet recording apparatus to which the ink droplet ejection amount control method of the present invention is applied.
Figure 9:
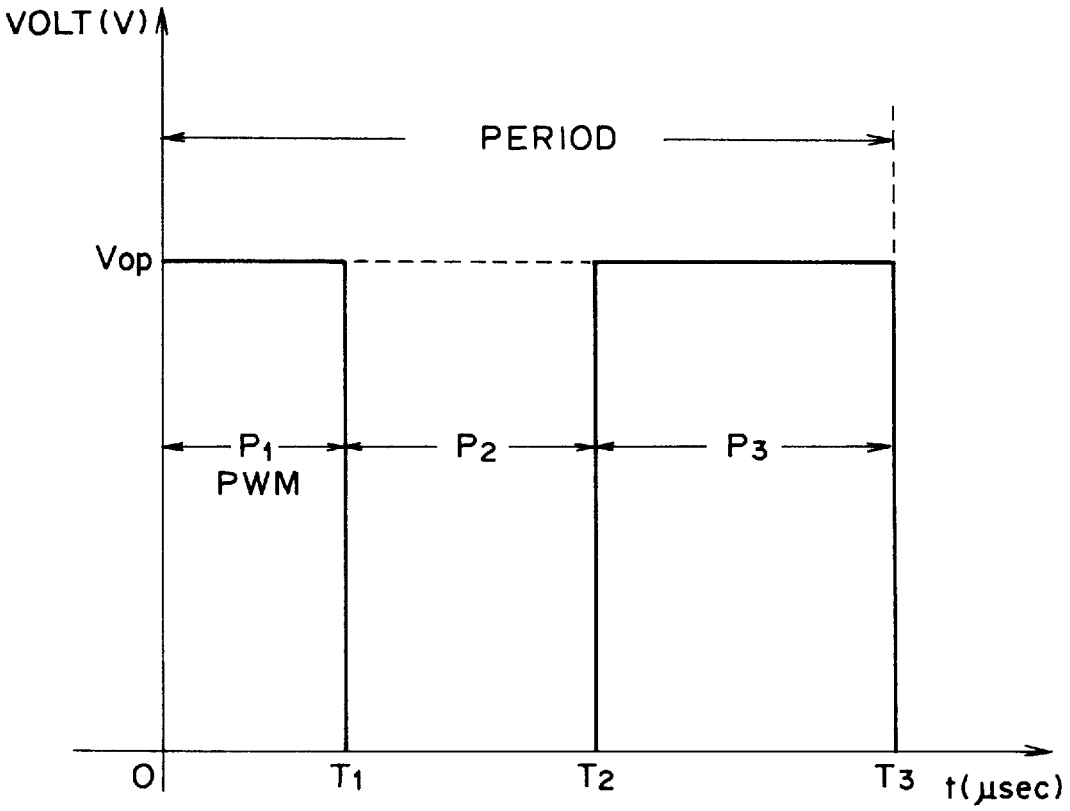
FIG. 9 PRIOR ART
FIG. 9 illustrates divided pulses with a conventional ink droplet ejection amount control method.
Figure 10A:
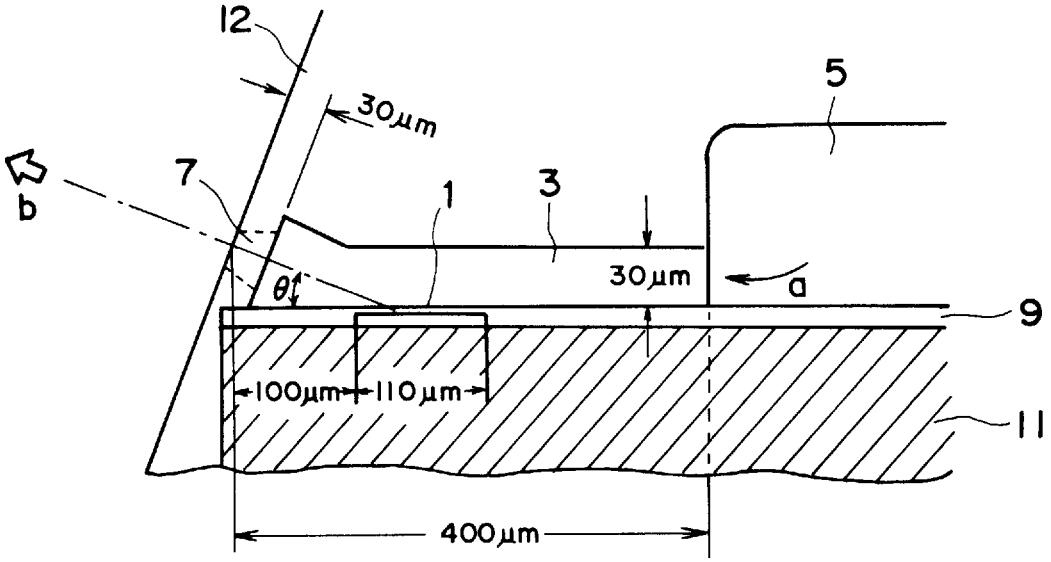
FIG. 10A PRIOR ART
FIG. 10A is a sectional view and FIG. 10B is a front view.
Figure 10B:
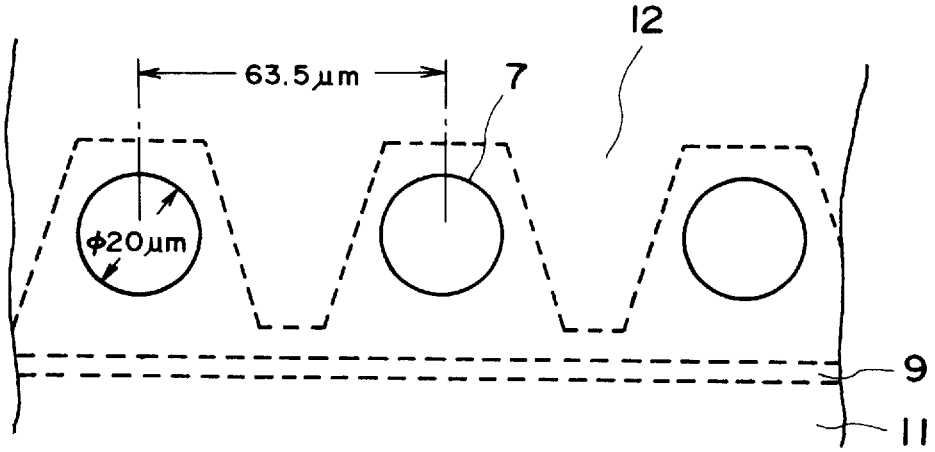
FIG. 10B PRIOR ART
Figure 11:
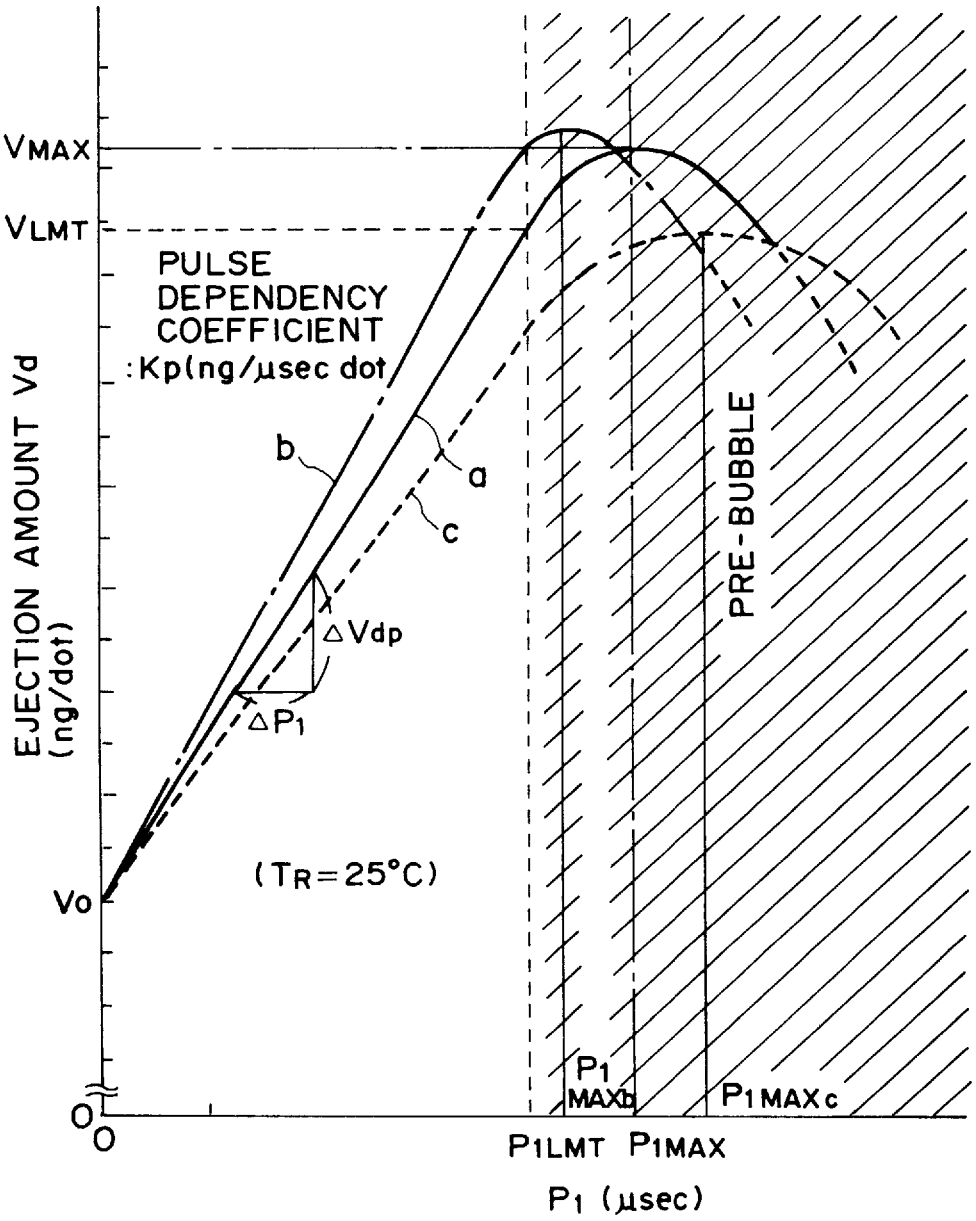
FIG. 11 PRIOR ART
FIG. 11 shows the pre-heat pulse dependency of the ink droplet ejection amount in a conventional ink droplet ejection amount control method.
Figure 12:
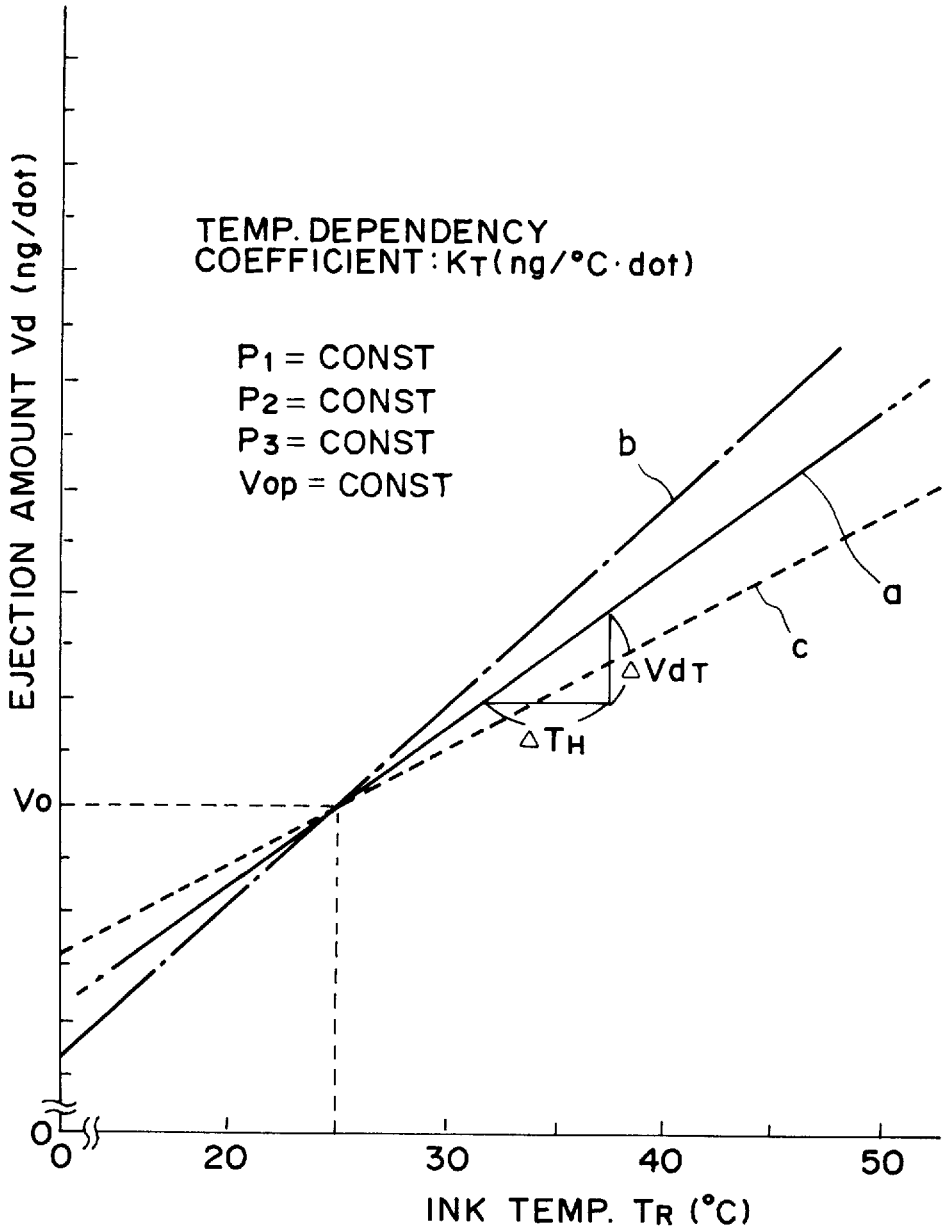
FIG. 12 PRIOR ART
FIG. 12 shows a temperature dependency of an ink droplet ejection amount in a conventional ink droplet ejection amount control method.

FIG. 8 is a block diagram of a control system in the above-described ink jet recording apparatus. A main controller 800 comprises CPU 801 in the form of a microcomputer, for example, for carrying out the sequential operations described above, a ROM 803 storing the program corresponding to the sequential process, the table, the voltage levels of the heat pulse, the pulse width or other fixed data, and a RAM 805 having a working area and an area for converting the image data.

Reference numeral 810 designates a host apparatus (which may be an image reader) functioning as a source of the image data, and the image data, the other command signals, status signals or the like are supplied or received with the controller through an interface (I/F) 812.

Reference numerals 820 designates a group of switches for inputting instructions by an operator, and the group includes a copy switch 824 for starting a recording or copying operation, a large scale recovery switch 826 for instructing actuation of a large scale recovery operation, or the like. Reference numeral 830 designates a group of sensors including a sensor 832 for detecting the position of the carriage 2 such as a home position or a start position or the like, a sensor 834 for detecting a pump position including leaf switch 530, and a sensor for detecting the state of the apparatus.

A head driver 840 functions to energize the electrothermal transducers of the recording head in accordance with the record data or the like. A part of the head driver is used to drive temperature keeping heaters 30A and 30B. The temperature detections from the temperature sensors 20A and 20B are introduced into the controller 800. A main scan motor 850 functions to move the carriage 2 in the main scan direction (A in FIG. 7) under the control of a diver 852. A sub-scan motor 820 functions to feed the recording material in the sub-scan direction. Here, the sensors 20A and 20B for detecting the temperature of the recording head are built in with the recording head, but the sensor may be disposed adjacent the head to detect the temperature which is used to select the driving condition.

The above-described ink jet recording apparatus is provided with recording head cartridges for the inks of cyan, magenta, yellow and black colors, respectively. Each of the recording head cartridges is provided with an EEPROM 128 for storing information. The information stored in the ROM 128 is read out upon actuation of the main switch of the ink jet recording apparatus. The ROM data to be read include an ID number of the recording head, ink color, driving condition, head shading (HS), table pointer storing control conditions for PWM control with data (table number). The table pointer is set in accordance with the power of ink ejection for each head. In accordance with the table pointer, the main assembly of the recording apparatus determines the upper limit of the pre-heat pulse P1 width in the divided pulse width modulation control. The table pointer (number) is set, and on the basis of that, the maximum width of the pulse width P1 is determined to be "OA" (1.87 μsec)

The description will be made briefly as to the head information reading process from a ROM 128.

First, the ID number (serial number) peculiar to the head is read in, and an investigation is made as to whether the serial number is FFFFH or not, for example. If the serial number is FFFFH, the absence of the head is discriminated, and therefore, the error is discriminated. If not, the color of the head is read. Subsequently, an investigation is made from the color information as to whether or not the head is mounted to a correct position determined for each color, and if it is correctly mounted, the next data is read, and if an erroneous mounting is detected, the head position error is displayed.

Subsequently, an investigation is made whether the mounted recording head cartridge is a new one or not by comparing the serial number of the recording head and the serial number stored in the memory. If it is not a new head, the head information reading process is completed. If it is a new head, the head information (serial number, color information, pulse width of the main pulse P3, PWM control table pointer, temperature correction value, head position correction value, manufactured dates and other information) is stored in the RAM 805 in the main assembly, and a flag indicative of the mounting of the new head is set.

Subsequently, the shading information (HS) of the head is read in, and the head information reading operation is completed.

The description will be made briefly as to the driving condition for the recording head. Here, the driving condition is related with the main pulse P3 for the ink ejection, and upon actuation of the main switch, the table pointer for the pulse P3 is read as the head driving condition together with the ID number, the color information and the table pointer for pulse P1 as the ROM information. In accordance with the table pointer, the main assembly determines the pulse width of the main heat pulse P3 for the divided pulse width modulation control, which will be described hereinafter.

The table pointer information for the pulse P3 is determined for each head as a result of ejection property measurement for each head during the manufacturing process, and is stored in the ROM 128 of the recording head.

The set condition (driving condition) in the main assembly is changed in accordance with the ROM information for the table pointer for the head driving condition setting, by which the ejection property variation for individual heads can be accommodated, so that the image quality can be easily stabilized even with the exchangeable recording head is used as in this example.

The table pointer information relating to the pre-heat pulse can be similarly set. This will be described briefly. During the head manufacturing process, the ejection amount for each head is measured under a standard driving condition (head temperature TH of 25.0° C., driving voltage Vop of 18.0 V, pulse width P1 of 4.87 μsec, pulse width P3 of 4.114 μsec), and the measured ejection amount is set in VDM. Subsequently, a difference between the VDM from the standard ejection amount VD0 (=30.0 ng/dot), is determined, and on the basis of the difference, the table pointer is selected. In this manner, the upper limit of the heat pulse is classified depending on the ejection amount determined by the individual properties of the recording heads, and the rank is stored in the ROM 128 as table pointer information.

Figure 15:
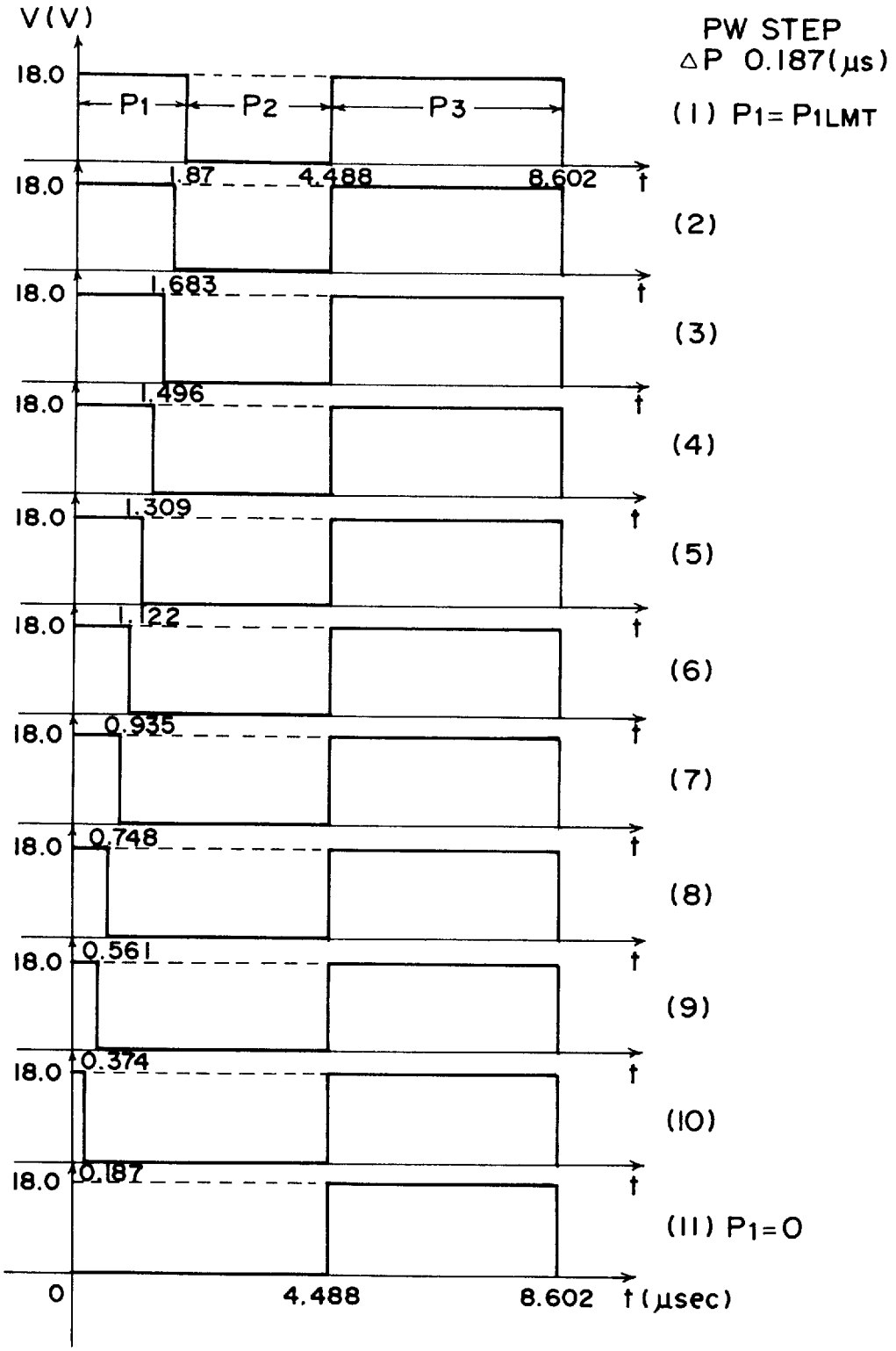
FIG. 15 PRIOR ART
FIG. 15 shows various states of pulse widths for respective tables in FIG. 14.
Figure 16:
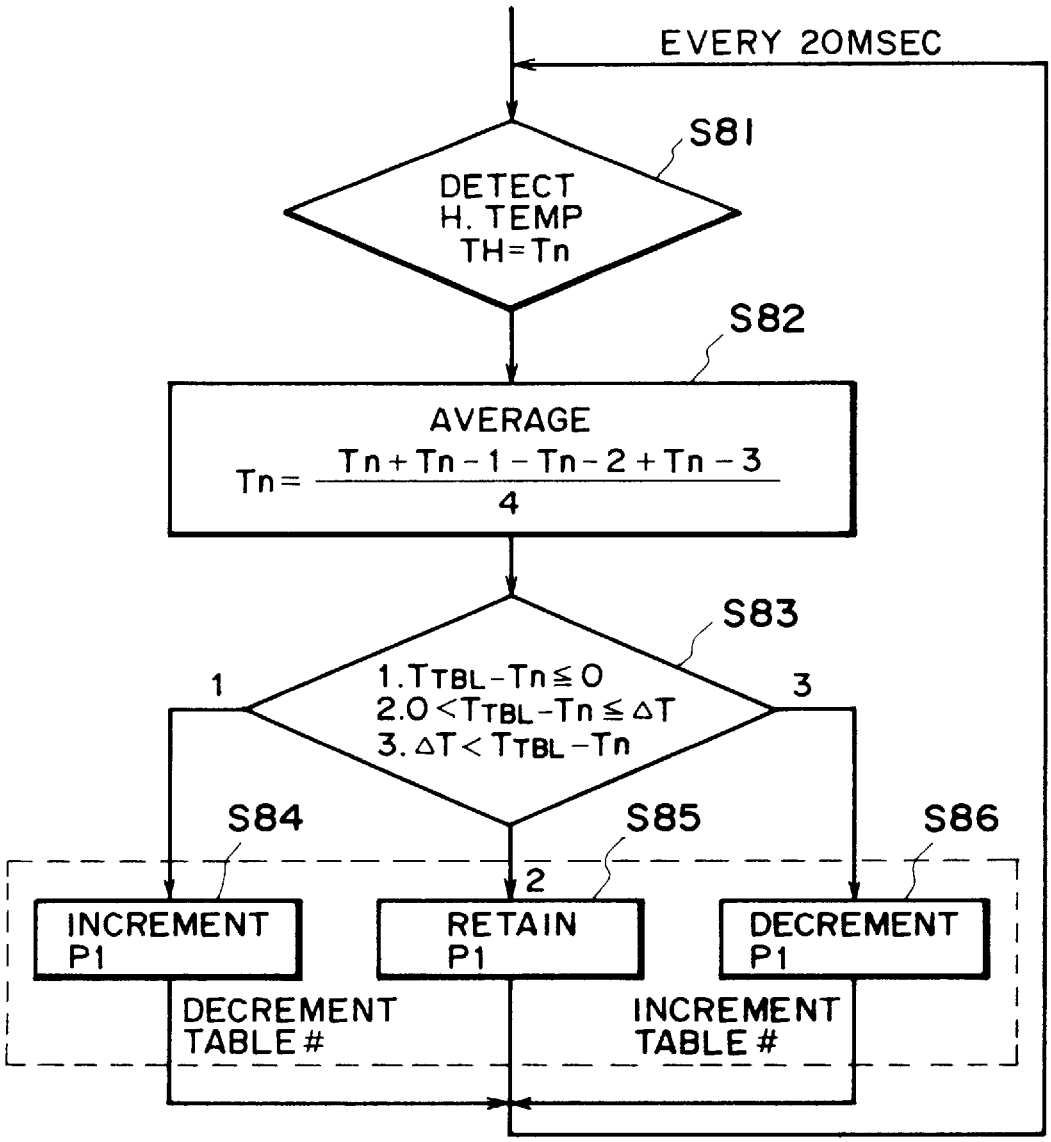
FIG. 16 PRIOR ART
FIG. 16 is a flow chart illustrating sequential operations of the pulse width modulation in the conventional ink droplet ejection amount control method.
Figure 17:
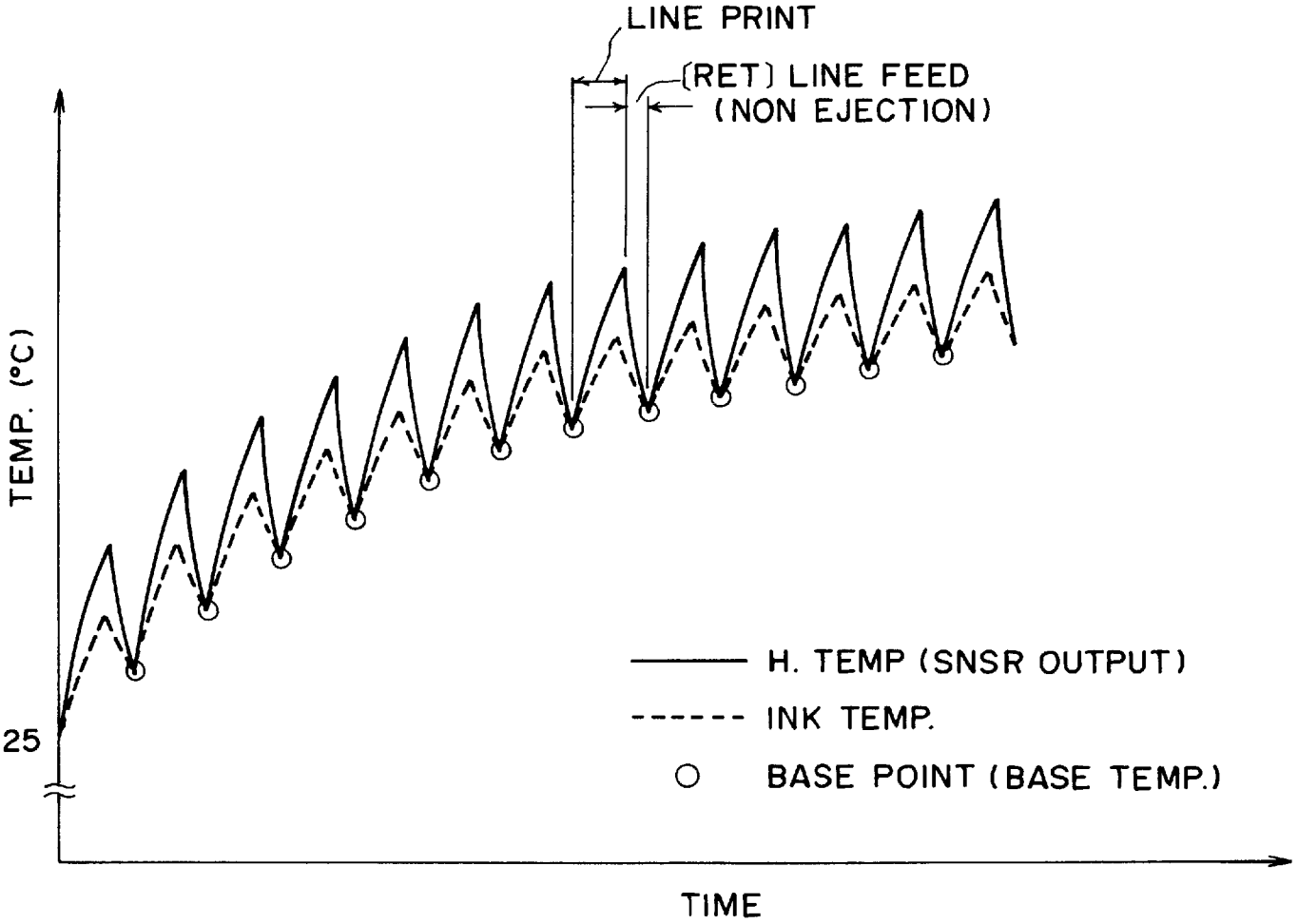
FIG. 17 PRIOR ART
FIG. 17 shows the head temperature and ink temperature changes when a 100% duty printing operation is carried out for a plurality of lines in an ink jet recording apparatus using a conventional ink droplet ejection amount control.
Figure 18:
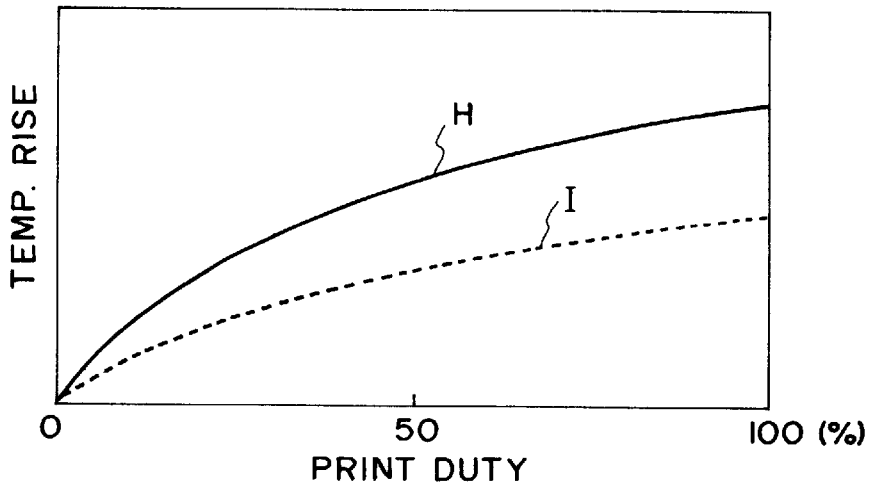
FIG. 18 PRIOR ART
FIG. 18 shows plots of recording head and ink temperature rises upon a printing operation against printing duty as a result of continuous one line printing in an ink jet recording apparatus using a conventional ink droplet ejection amount control.

Such classification depending on the ejection amount is such that the range of one rank is equal to the shift amount of one table ±δV for the pulse width P1 of the pre-heat pulse shown in FIGS. 14 and 15.

Table pointer selection for the pre-heat pulse Pi is as follows. For the recording head exhibiting a large ejection amount, the upper limit for the pre-heat pulse width Pi under the standard temperature (5.0° C., for example) of the ambient temperature (head temperature) is made shorter than the upper limit (P1=1.87 μsec, for example) of the standard driving condition, thus reducing the ejection amount to make it closer to the standard ejection amount VD0=30.0 (ng/dot).

On the contrary, for the recording head exhibiting a smaller ejection amount, the pre-heat pulse width P1 upon the standard temperature of the ambient temperature is made longer than the standard driving condition, thus increasing the ejection amount to make it closer to the standard ejection amount VD0 of 30.0 (ng/dot).

In this manner, the table pointer for the PWM control of the pre-heat pulse P1 is read in as the ROM information, and the setting condition (driving condition) of the main assembly can be changed in accordance with the information. By doing so, the variations in the ejection amount for the individual head can be accommodated, so that the quality of the image can be easily stabilized even in the case of the use of the exchangeable recording head. In addition, the yield of the recording head manufacturing is improved, thus reducing the manufacturing cost of the head cartridge.

Figure 13:
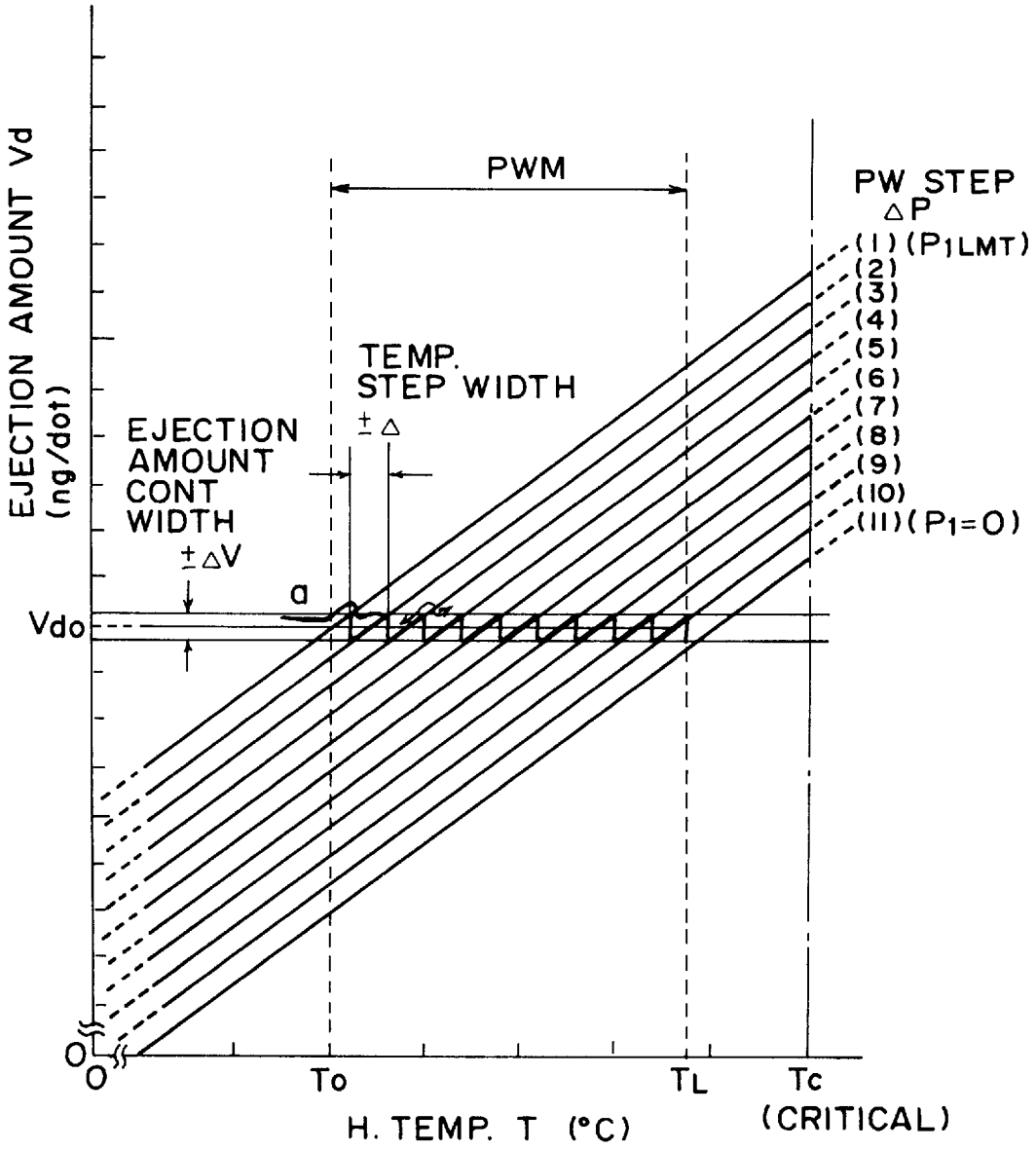
FIG. 13 PRIOR ART
FIG. 13 illustrates a pulse width modulation for suppressing variation of ejection amount (Vd) corresponding to a change of the head temperature (TH) in a conventional ink droplet ejection amount control method.

As described referring to FIGS. 1–8, by modulating the initial part of the divided pulses functioning as the driving signals for the ejection energy generating element, the amount of the ejection is stabilized, and in addition, the temperature of the recording head can be efficiently controlled. Additionally, the controllable width of the recording head temperature is relatively large from T0 to TL, as shown in FIG. 13, for example.

Embodiment 2

In Embodiment 1, the different tables are used in the ejection period and the non-ejection period to avoid the problem arising from the difference in the ink temperature and the head temperature. The similar advantageous effects can be provided by using equations to convert the values of the tables.

In Embodiment 1, the value of the pre-heat pulse of the second table has the following relationship with the value of the first table. The pulse width of the pre-pulse upon the start of the printing is assumed as PS, and the temperature at that time is assumed as TS. The upper limit temperature of the temperature range corresponding to the pulse width P of the first table is assumed as TTBL1 (P), and the upper limit temperature in the temperature range corresponding to the pulse width P of the prepulse of the second table is assumed as TTBL2 (P).

Then, $$\begin{aligned} TTBL2\,(P) &= (TTBL1\,(P) = TS) \times \frac{3}{5} + TS \\ &= \frac{3}{5}\,TTBL1\,(P) + \frac{2}{5}\,TS \end{aligned}$$

By effecting the pulse width control using the value provided by processing the value of the first table, during the ejection, the same control as in the first embodiment can be carried out. Actually, it has been confirmed that the same advantageous effects are provided as in the first embodiment. In this embodiment, there is no need of preparing different tables for the ejection period and the non-ejection period, so that the capacity of the ROM or the like is reduced, so that the cost can be reduced.

Embodiment 3

In the second embodiment, the pulse width control is carried out using equations and Table 1, but in this embodiment, the ink temperature is calculated on the basis of the head temperature during the ejection operation, and the control is carried out using the temperature and the first table. In this embodiment, the same advantageous effects as in the first embodiment and the second embodiment can be provided.

The head temperature upon the start of the printing operation is assumed as TS (upon the print operation start, the head temperature and the ink temperature are substantially equal). The head temperature T1 and ink temperature Tink during the printing operation, are related as follows:

$$Tink = (TH - TS) \times \frac{3}{5} + TS = \frac{3}{5}\ TH + \frac{2}{5}\ TS$$

During a non-printing period, the value of the temperature sensor (head temperature) is used as it is to determine the pulse width, and during the ejection period, the ink temperature is calculated using the equation, and the pulse width control is carried out using the result of the calculation. By doing so, it has been confirmed that the same advantageous effects as in Embodiment 1 can be provided.

Embodiment 4

In the first embodiment, the minimum unit (δP in FIG. 15) for the pre-heat pulse modulation is made constant (0.187 μsec, 1 step), and the control is effected with the temperature step to change the degree of the modulation of the energy applied to the recording head. In this embodiment, the modulation control table for the pulse width is not changed, that is, the temperature step δT is made constant, and the minimum unit δP for the pre-heat pulse is changed. In the head used in this embodiment, the minimum changing unit for the pre-heat pulse during the ejection operation is δP' which is:

$$\delta P = \frac{3}{5}\ \delta P$$

For example, when the printing operation is carried out at 25° C., P1 is OA (Hex) when the head temperature is 25° C. in the first table, and the length of the pre-heat pulse is 10δP (δP=0.187 μsec). When the temperature increases to 30° C., the length of the preheat pulse is 10δP–3δP' (δP'=0.112 μsec). Similarly, when the temperature increases up to 35° C. from the starting temperature of 30° C., it is 0.7δP–20δP'.

The energy applied to the recording head by this control is exactly equal to that in the first embodiment, and it has been confirmed that the same advantageous effect can be provided in the stabilization of the ejection amount.

In the foregoing embodiments, the pre-heat pulse portion of the double pulses is controlled to control the ink temperature, by which the ejection speed is controlled. However, the present invention is advantageous in a control method in which the ejection amount is controlled by modulating the energy of the driving pulse, such as a pulse width control for a single pulse or a voltage control for a driving pulse (single pulse or pre-heat pulse of double pulses).

Other Embodiment

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from the nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the abovementioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of recovery means and/or the auxiliary means for the preliminary operation are preferable, because they can further stabilize the effects of the present invention. As for such means, there are capping means for the recording head, cleaning means therefor, pressurizing or suctioning means, and preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to a plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be performed with an integrally formed recording unit or a combination of plural recording heads.

Furthermore, in the foregoing embodiment, the ink has been liquid. It may be, however, an ink material which is solidified below room temperature but liquefied at room temperature. Since the ink is controlled within the temperature not lower than 30° C. and not higher than 70° C. to stabilize the viscosity of the ink to provide the stabilized ejection in a typical recording apparatus of this type, the ink may be such that it is liquid within the temperature range when the recording signal is sent. The present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through-holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as a computer or the like, as a copying apparatus combined with an image reader or the like, or as a facsimile machine having information sending and receiving functions.

As described in the foregoing, according to the present invention, the ink can be ejected with a stabilized ejection amount by controlling the recording head drive using a different control table or using a control table changing equation, for modulating the driving signal to be applied to the recording head, in accordance with the ink temperature, even if the head temperature and the ink temperature are different due to printing duty.

While the invention has been described with reference to the structures disclosed herein, it is not confined to the details set forth and this application is intended to cover such modifications or changes as may come within the purposes of the improvements or the scope of the following claims.

What is claimed is:

1. An ink ejection control method for an ink jet recording apparatus using a recording head for ejecting ink, said method comprising the steps of:

detecting operating conditions relating to a state of ink ejection from the recording head;

detecting temperature adjacent to the recording head; and changing a driving signal for driving the recording head for ejecting ink from the recording head, based on results of said state detecting step and said temperature detecting step.

2. A method according to claim 1, wherein said changing step comprises modulating the driving signal for driving the recording head.

3. A method according to claim 2, wherein said changing step comprises effecting the modulation with different modulation widths during a recording period and a non-recording period.

4. A method according to claim 3, wherein said changing step comprises effecting the modulation with the modulation widths being smaller in the recording period than in the non-recording period.

5. A method according to claim 2, wherein said changing step comprises effecting the modulation using different control tables related to the head temperature during a recording period and a non-recording period.

6. A method according to claim 2, wherein said changing step comprises effecting the modulation using the same control tables related to the head temperature during a recording period and a non-recording period.

7. A method according to claim 2, wherein said changing step comprises modulating the driving signal in the form of a pulse signal including a first pulse not sufficient to eject the ink and a second pulse sufficient to eject the ink.

8. A method according to claim 7, wherein said changing step comprises modulating the driving signal with a rest period provided between the first pulse and the second pulse.

9. A method according to claim 1, wherein the recording head detected in said state detecting step comprises an electrothermal transducer, responsive to the driving signal, for generating thermal energy to produce film boiling of ink to eject the ink from the recording head.

10. An ink jet recording apparatus using a recording head for ejecting ink to effect recording on a recording material, comprising:

state detecting means for detecting operating conditions relating to a state of ink ejection from the recording head;

temperature detecting means for detecting temperature adjacent to the recording head; and changing means for changing a driving signal for driving the recording head to eject ink from the recording head, based on results of said state detecting means and said temperature detecting means.

11. An apparatus according to claim 10, wherein said changing modulates a driving signal for driving the recording head.

12. An apparatus according to claim 11, wherein said changing means effects the modulation with different modulation widths during a recording period and a non-recording period.

13. An apparatus according to claim 12, wherein the modulation widths are smaller in the recording period than in the non-recording period.

14. An apparatus according to claim 11, wherein said changing means effects the modulation using different control tables related to the head temperature during a recording period and a non-recording period.

15. An apparatus according to claim 11, wherein said changing means effects the modulation using the same control tables related to the head temperature during a recording period and a non-recording period.

16. An apparatus according to claim 11, wherein the driving signal is in the form of a pulse signal including a first pulse not sufficient to eject the ink and a second pulse sufficient to eject the ink.

17. An apparatus according to claim 16, wherein a rest period is provided between the first pulse and the second pulse.

18. An apparatus according to claim 10, wherein the recording head has an electrothermal transducer, responsive to a driving signal, for generating thermal energy to produce film boiling of ink to eject the ink from the recording head.

19. An ink ejection control method for an ink jet recording apparatus using a recording head for ejecting ink, said method comprising the steps of:

detecting an operating condition of whether the recording head is in an ink ejecting state or a non-ejecting state;

detecting temperature adjacent to the recording head;

driving the recording head with a driving signal for ejecting ink from the recording head in accordance with a result of said temperature detecting step; and modulating the driving signal, when a driving state change is detected in at least one of said operating condition detecting step and said temperature detecting step.

20. A method according to claim 19, wherein said operating condition detecting step comprises detecting whether the recording apparatus is in a recording period or a non-recording period.

21. A method according to claim 19, wherein the recording head detected in said operating condition detecting step comprises an electrothermal transducer, responsive to the driving signal, for generating thermal energy to produce film boiling of ink to eject the ink from the recording head.

22. An ink jet recording apparatus using a recording head for ejecting ink, comprising:

state detecting means for detecting whether the apparatus is in a recording period or a non-recording period;

temperature detecting means for detecting temperature adjacent to the recording head; and control means for modulating a drive signal for driving the recording head to eject the ink from the recording head, based on results of said state detecting means and said temperature detecting means, wherein said control means effects the modulation differently during a recording period and a non-recording period, and said control means controls the drive signal when said state detecting means detects a change of the state or when said temperature detecting means detects a temperature change.

23. An apparatus according to claim 22, wherein the recording head comprises an electrothermal transducer, responsive to the drive signal, for generating thermal energy to eject the ink from the recording head.

* * * * *

UNITED STATES PATENT AND TRADEMARK OFFICE

CERTIFICATE OF CORRECTION

PATENT NO. : 5,880,751 Page 1 of 2

DATED : March 9, 1999

INVENTOR(S) : NISHIKORI ET AL.

Figure 22:
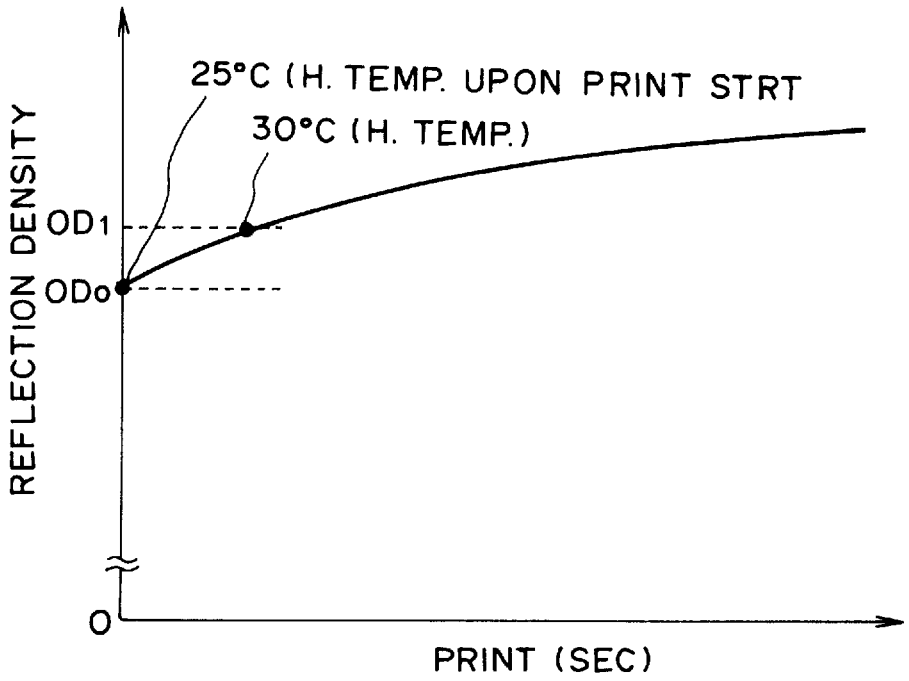
FIG. 22 PRIOR ART
FIG. 22 shows a reflection optical density change due to self temperature rise of the recording head when a 100% duty one line printing operation is carried out with the pulse width fixed in an ink jet recording apparatus using a conventional ink droplet ejection amount control method.

It is certified that error appears in the above-identified patent and that said Letters Patent is hereby corrected as shown below:

In the drawing:

DRAWING SHEET 19 of 19:

Figure 22, "STRT" should read --STRT)--.

COLUMN 6:

Line 51, "represent" should read --represents--.

COLUMN 10:

Line 17, "is" should read --and--.

COLUMN 12:

Line 26, "numerals" should read --numeral--.

Line 44, "diver" should read --driver--.

COLUMN 13:

Line 48, "is" should read --being--.

UNITED STATES PATENT AND TRADEMARK OFFICE

CERTIFICATE OF CORRECTION

PATENT NO. : 5,880,751 Page 2 of 2

DATED : March 9, 1999

INVENTOR(S) : NISHIKORI ET AL.

It is certified that error appears in the above-indentified patent and that said Letters Patent is hereby corrected as shown below:

COLUMN 18:

Line 40, "changing" should read --changing means--.

Signed and Sealed this

Twelfth Day of October, 1999

*Attest:*

Q. TODD DICKINSON

*Attesting Officer*

*Acting Commissioner of Patents and Trademarks*